US012595732B2

(12) United States Patent
Yu et al.

(10) Patent No.: US 12,595,732 B2
(45) Date of Patent: Apr. 7, 2026

(54) SYSTEMS AND METHODS FOR DETERMINING DEFORMATION OF A TOOL STRING

(71) Applicant: Schlumberger Technology Corporation, Sugar Land, TX (US)

(72) Inventors: Hua Yu, Beijing (CN); Li Chen, Beijing (CN); Adriaan Gisolf, Bucharest (RO); Jiankun Yang, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/826,311

(22) Filed: Sep. 6, 2024

(65) Prior Publication Data

US 2025/0188834 A1 Jun. 12, 2025

Related U.S. Application Data

(60) Provisional application No. 63/608,847, filed on Dec. 12, 2023.

(51) Int. Cl.
*E21B 49/08* (2006.01)
*E21B 47/09* (2012.01)

(52) U.S. Cl.
CPC ..... *E21B 49/087* (2013.01); *E21B 47/09* (2013.01); *E21B 2200/20* (2020.05)

(58) Field of Classification Search
CPC ..... E21B 47/06; E21B 47/007; E21B 47/00; E21B 47/07; E21B 47/01; E21B 49/006;
(Continued)

(56) References Cited

U.S. PATENT DOCUMENTS 3,764,168 A 10/1973 Kisling, III et al.
8,863,852 B2 10/2014 Clausen
(Continued)

FOREIGN PATENT DOCUMENTS

WO 2011044028 A2 4/2011
WO WO-2021242242 A1 * 12/2021 ..... G01L 9/0027

OTHER PUBLICATIONS

Kassim, M.A., et al., Dynamic Well Control Simulation to Ensure Safer Sampling and Deep Transient Testing: Case Studies from the Southeast Asia Region, SPE/IADC Middle East Drilling Technology Conference and Exhibition, May 23, 2023, pp. 1-24.
(Continued)

*Primary Examiner* — Zakiya W Bates
(74) *Attorney, Agent, or Firm* — Jeffrey D. Frantz

(57) ABSTRACT

A method of predicting loading of a tool string implemented in a wellbore includes, for a formation testing operation of the wellbore, receiving temperature data for the wellbore and receiving pressure data for a fluid flowing through the tool string. The method includes, for the formation testing operation of the wellbore, estimating a deformation of the tool string based on the temperature data and the pressure data and based on physical properties of the tool string including determining thermal deformation of the tool string. The method further includes, for the formation testing operation of the wellbore, predicting one or more internal force of the tool string based on the deformation.

20 Claims, 11 Drawing Sheets

(58) Field of Classification Search
CPC ..... E21B 47/09; E21B 49/00; E21B 47/16; E21B 2200/20; E21B 47/12; E21B 49/08; E21B 49/087
See application file for complete search history.

(56) References Cited

U.S. PATENT DOCUMENTS

2012/0305315 A1 12/2012 Bedouet
2016/0084019 A1 3/2016 Montiel et al.

OTHER PUBLICATIONS

Oliveira, J., et al., Deep Transient Testing Digital Products Create Novel Real-Time Reservoir Insights, SPWLA 62nd Annual Logging Symposium, Virtual Event, May 17, 2021, pp. 1-26.
Chia, C.R., "A New Method for Improving LWD Logging Depth", SPE Annual Technical Conference and Exhibition, Sep. 24, 2006.
Lubinski, A. et. al., "Helical Buckling of Tubing Sealed in Packers", Journal of Petroleum Technology, Jun. 1, 1962, pp. 655-670, vol. 14, No. 6.
Hammerlindl, D. J., "Movement, Forces, and Stresses Associated With Combination Tubing Strings Sealed in Packers", Journal of Petroleum Technology, Feb. 1, 1977, pp. 195-208, vol. 29, No. 2.

* cited by examiner

SYSTEMS AND METHODS FOR DETERMINING DEFORMATION OF A TOOL STRING

CROSS-REFERENCE TO RELATED APPLICATIONS

This application claims priority to and the benefit of U.S. Provisional Patent Application No. 63/608,847, filed Dec. 12, 2023, which is incorporated herein by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Once drilling of some or all of a wellbore is completed, tests are often performed to evaluate various aspects of the wellbore and/or an associated formation. Formation evaluation tests in particular may test the formation fluids and/or the flow of the formation fluids by implementing a formation evaluation tool downhole. In many cases, these formation evaluation tools are fixed in place with a packer in order to maintain their relative position with respect to a formation. Deformation of the tool string, such as thermal expansion and/or compression of the tool string, may subject the packer to compressive and/or tensile forces which may tend to move the packer, or which may pose a risk of the packer and/or the formation becoming damaged. These and other potential effects may result in catastrophic damage and failure to the downhole system. Thus, systems and methods for determining deformation and associated loading of a tool string during formation evaluation operations may be advantageous.

SUMMARY

In some embodiments, a method of predicting loading of a tool string implemented in a wellbore includes, for a formation testing operation of the wellbore, receiving temperature data for the wellbore and receiving pressure data for a fluid flowing through the tool string. The method includes, for the formation testing operation of the wellbore, estimating a deformation of the tool string based on the temperature data and the pressure data and based on physical properties of the tool string including determining thermal deformation of the tool string. The method further includes, for the formation testing operation of the wellbore, predicting one or more internal force of the tool string based on the deformation. In some embodiments, the method is performed by a system. In some embodiments, the method is performed as instructions stored on computer-readable media.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure may be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 illustrates an example implementation of a downhole testing operation;

FIGS. 3-2 through 3-4 illustrate an example implementation of a downhole testing operation;

FIG. 4 illustrates an example implementation of a tool string deformation system as described herein, according to at least one embodiment of the present disclosure;

DETAILED DESCRIPTION

Figure 1:
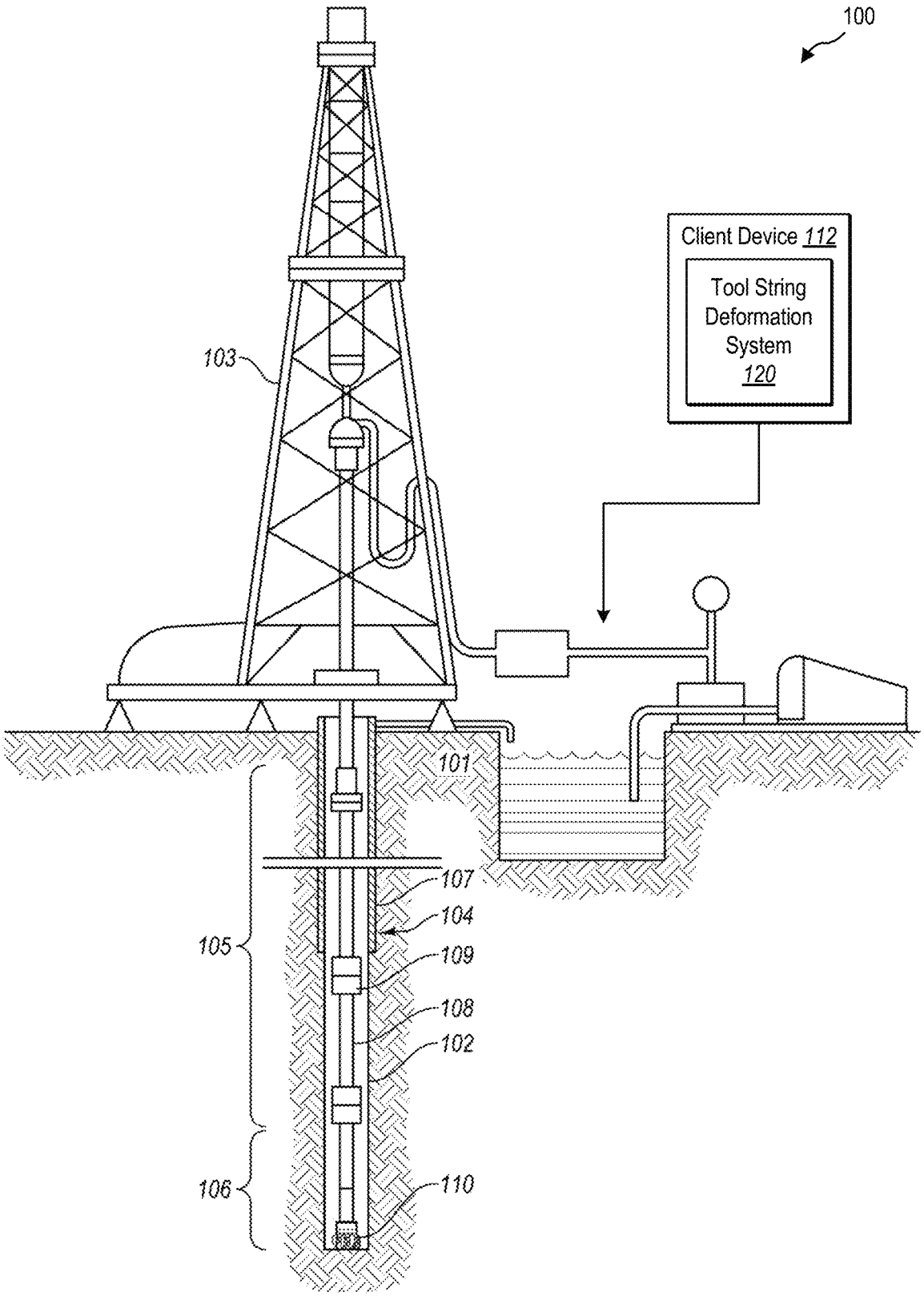
FIG. 1 is an example of a downhole system, according to at least one embodiment of the present disclosure.

This disclosure generally relates to systems and methods for estimating the deformation that a tool string will undergo during a formation evaluation operation. For example, during a formation evaluation operation, a downhole tool may be fixed in place in a wellbore by a packer, and the downhole tool may be connected to a tool string by a slip joint. The tool string may experience various modes of deformation, such as from thermal expansion and contraction. It may be desirable, in at least some embodiments, to predict the amount of deformation of the tool string to ensure that a throw of the slip joint is not exceeded, and if so, that the further deformation does not result in forces within the tool string that exceed operational limits of one or more components.

In some embodiments, a computer-implemented tool string deformation system may facilitate estimating the tool string deformation and/or determining the resulting internal tool string forces. The tool string deformation system may receive temperature data indicating a temperature profile throughout the wellbore. The tool string deformation system may receive pressure data indicating a pressure (e.g., internal, external, pressure differential, etc.) profile of at least a portion of the drilling fluid flowing through the tool string. The temperature data and/or pressure data may be based on a combination of measured and estimated values. For example, the tool string deformation system may run a simulation of the tool string in the wellbore and of the drilling fluid flowing through the tool string in order to determine the temperature and/or pressure at various measurement depths.

Based on the temperature and pressure profiles, the tool string deformation system may predict the deformation that the tool string will experience during the formation evaluation operation. The tool string deformation system may determine various modes of deformation such as one or more of thermal deformation, ballooning deformation, or helical buckling deformation. By modeling one or more of these modes of deformation, the tool string deformation system may determine a net change in length of the tool string at one or more instances during the formation evaluation operation. By determining the deformation, the tool string deformation system may determine the loading on the tool string by calculating the forces resulting within the tool string. For example, the deformation may indicate that a compressive and/or expansive limit of the slip joint will be reached, and that further deformation may create internal forces on the tool string. These internal forces may apply a resulting tensile and/or compressive force on the formation evaluation tool and/or the packer. Thus, the tool string deformation system may facilitate determining if and to what extend the packer may experience unwanted pushing and/or pulling forces. This may facilitate planning and/or implementing the formation evaluation operation to avoid failure of the string and/or packer.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a tool string 105, a bottomhole assembly ("BHA") 106, and a bit 110, attached to the downhole end of the tool string 105.

The tool string 105 may include several joints of drill pipe 108 connected end-to-end through tool joints 109. The tool string 105 transmits drilling fluid through a central bore and transmits rotational power from the drill rig 103 to the BHA 106. In some embodiments, the tool string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between the tool string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the tool string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

In some embodiments, the downhole system 100 includes or is associated with one or more client devices 112 with a tool string deformation system 120 implemented thereon (e.g., implemented on one, several, or across multiple client devices 112). The tool string deformation system 120 may facilitate predicting the deformation that the tool string may experience during an operation of the downhole system 100. While the client devices 112 and the tool string deformation system 120 are shown as pertaining to a (e.g., active) operation of the downhole system 100, it should be understood that the tool string deformation system 120 may be implemented in accordance with that described herein as part of a simulation, planning, or potential operation of a downhole system, and is not necessarily limited to an actual or current downhole operation.

Figure 2:
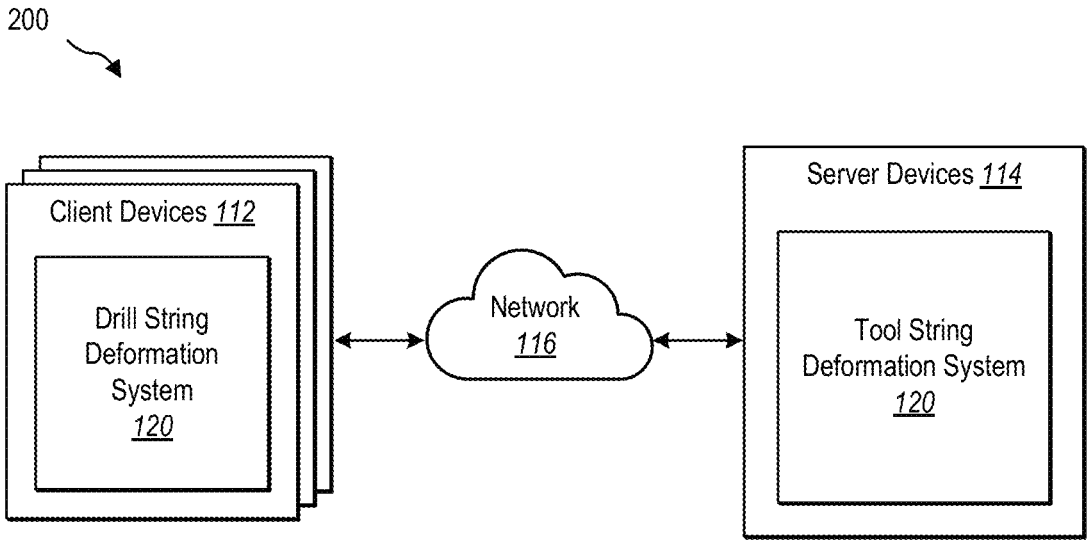
FIG. 2 illustrates an example environment in which a tool string deformation system is implemented, according to at least one embodiment of the present disclosure.

FIG. 2 illustrates an example environment 200 in which a tool string deformation system 120 is implemented in accordance with one or more embodiments describe herein. As shown in FIG. 2, the environment 200 includes one or more server device(s) 114. The server device(s) 114 may include one or more computing devices (e.g., including processing units, data storage, etc.) organized in an architecture with various network interfaces for connecting to and providing data management and distribution across one or more client systems. As shown in FIG. 2, the server devices 114 may be connected to and may communicate with (either directly or indirectly) one or more client devices 112 through a network 116. The network 116 may include one or multiple networks and may use one or more communication platforms and/or technologies suitable for transmitting data. The network 116 may refer to any data link that enables transport of electronic data between devices of the environment 200.

The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may refer to various types of computing devices. For example, one or more client devices 112 may include a mobile device such as a mobile telephone, a smartphone, a personal digital assistant (PDA), a tablet, a laptop, or any other portable device. Additionally, or alternatively, the client devices 112 may include one or more non-mobile devices such as a desktop computer, server device, surface or downhole processor or computer (e.g., associated with a sensor, system, or function of the downhole system), or other non-portable device. In one or more implementations, the client devices 112 include graphical user interfaces (GUIs) thereon (e.g., a screen of a mobile device). In addition, or as an alternative, one or more of the client devices 112 may be communicatively coupled (e.g., wired or wirelessly) to a display device having a graphical user interface thereon for providing a display of system content. The server device(s) 114 may similarly refer to various types of computing devices. Each of the devices of the environment 200 may include features and/or functionalities described below in connection with FIG. 8.

As shown in FIG. 2, the environment 200 may include a tool string deformation system 120 implemented on one or more computing devices. The tool string deformation system 120 may be implemented on one or more client devices 112, server devices 114, and combinations thereof. Additionally, or alternatively, the tool string deformation system 120 may be implemented across the client devices 112 and/or the server devices 114 such that different portions or components of the tool string deformation system 120 are implemented on different computing devices in the environment 200. In this way, the environment 200 may be a cloud computing environment, and the tool string deformation system 120 may be implemented across one or more devices of the cloud computing environment in order to leverage the processing capabilities, memory capabilities, connectivity, speed, etc., that such cloud computing environments offer in order to facilitate the features and functionalities described herein.

Figures 1, 3:
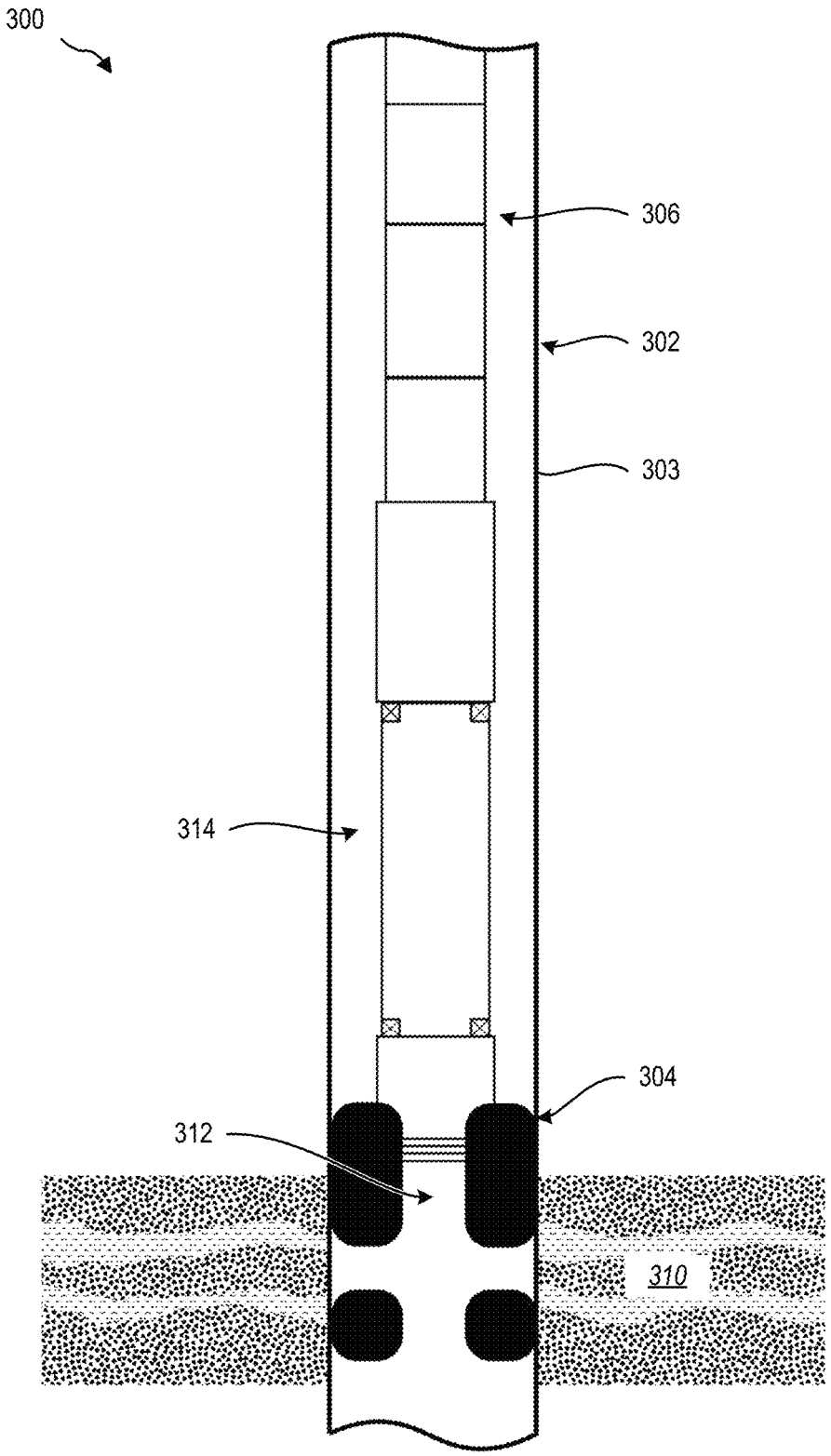
Figures 2, 3:
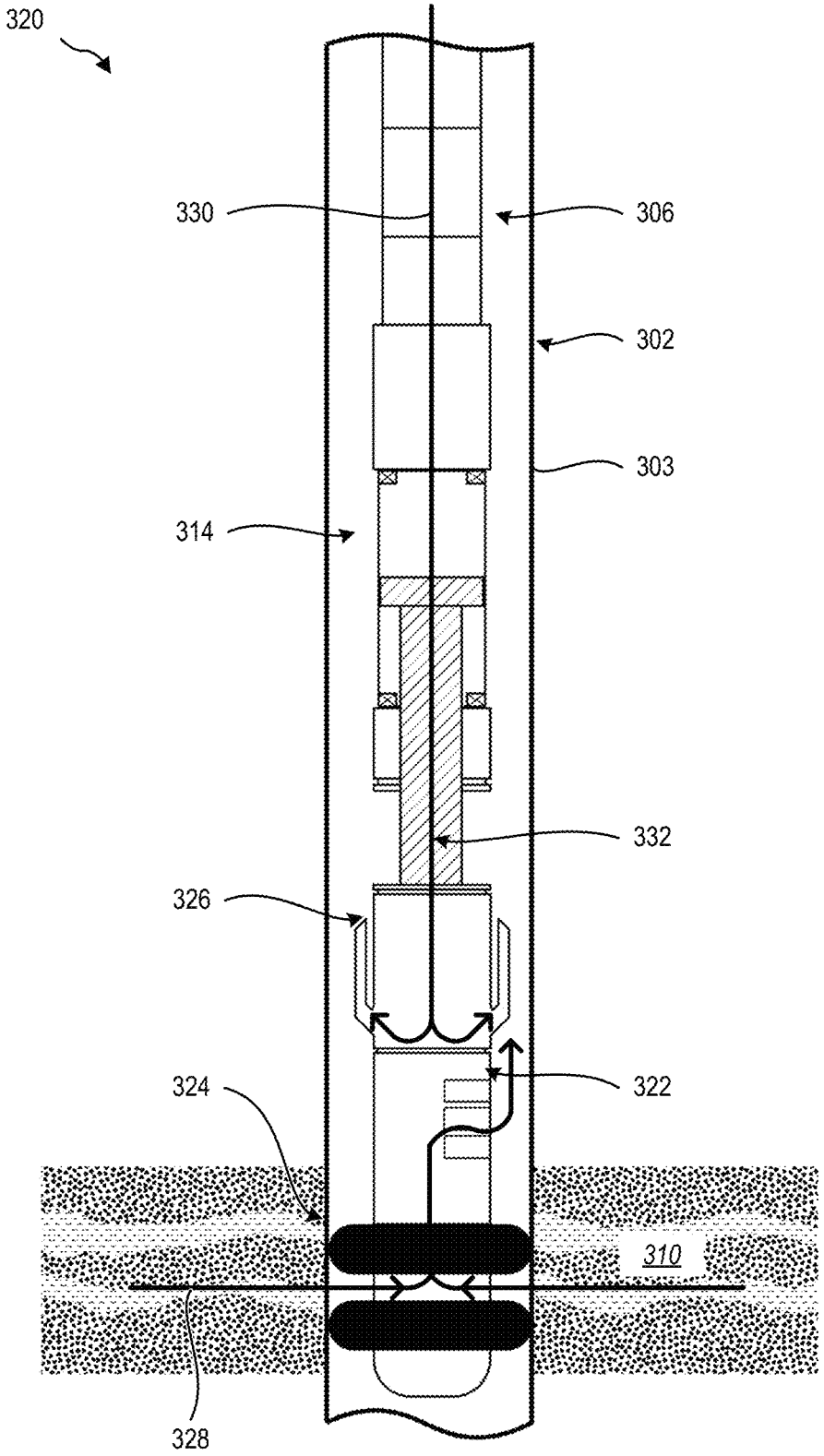
Figure 3:
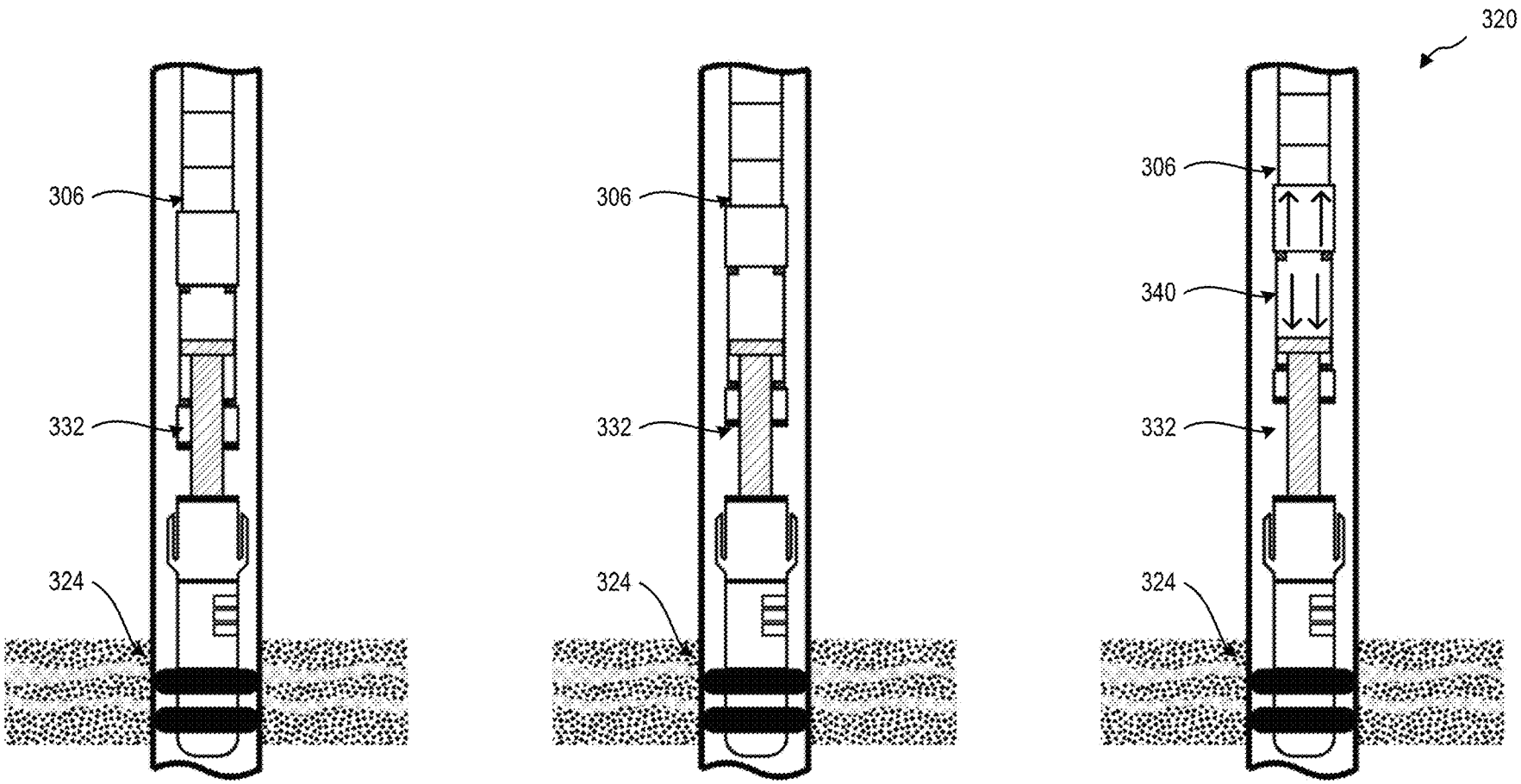

FIG. 3-1 illustrates an example implementation 300 of a downhole testing operation. The example implementation 300 may be an example of a typical downhole testing operation, such as a well testing operation. In example implementation 300 (e.g., well testing operation), a packer 304 may be implemented in a wellbore 302 and fixed in place, for example, in order to fix a position of a tool string 306 or to isolate specific segments of the wellbore 302 formation, reservoir, etc., among other functions. The tool string 306 may be a production string for circulating downhole fluids, producing formation fluids, etc. As shown, the tool string 306 may be directly connected to the packer 304 such that a bottom end 312 of the tool string 306 is fixed. In this way, an axial position of the tool string 306 may be fixed from the bottom end 312 of the tool string 306.

As shown, the tool string 306 may be connected to the packer 304. In some embodiments, the bottom end 312 of the tool string 306 may be an open end and may be open to the wellbore 302 beneath the packer 304. As mentioned above, the packer 304 may be positioned relative to a reservoir or formation 310, and may isolate the formation 310 from other portions of the wellbore 302. In some embodiments, formation fluids may be permitted to flow from the formation 310, into and up the tool string 306, for example, such that they may flow to the surface where they may be collected and/or sampled. In this way, an annulus 314 between the tool string 306 and a wellbore wall 303 may be isolated, via the packer 304, from the portion of the wellbore 302 below the packer 304. Similarly, the annulus 314 may be isolated from the bottom (e.g., open) end 312 of the tool string 306.

In some embodiments, the tool string 306 may experience deformation due to the downhole environment. Some conventional techniques may classify and/or quantify this deformation based on characterizing one or more modes of deformation of the tool string 306. For example, some techniques may take into account thermal deformation due to thermal expansion and/or contraction of the tool string 306. In other examples, conventional techniques may take into account a piston effect due to fluids flowing into and/or out of the tool string 306 (e.g., at the bottom end 312). In other examples, techniques may incorporate ballooning of the tool string 306. For example, based on the inner portion of the tool string 306 being isolated from the annulus 314, a pressure differential may cause the tool string 306 to deform outward (e.g., inflate like a balloon) or inward (e.g., reverse ballooning), which may cause a corresponding axial deformation due to Poisson's ratio. In another example, conventional techniques may account for pressure-induced helical buckling due to the pressure differential between the annulus 314 and inside the tool string 306.

Thus, while conventional techniques and known formulas may be suitable for determining deformation of a tool string for well testing scenarios, such as the example implementation 300, these techniques may only be applicable and/or accurate for downhole testing operations that are the same or similar to the example implementation 300 as described. For example, these conventional techniques may not be effective for accurately describing deformation in situations where a tool string is slidably fixed and/or not rigidly fixed to a packer at a bottom, open end. As another example, these conventional techniques may not be effective for accurately determining deformation in downhole testing operations where the downhole end of a tool string is isolated from the annulus, and/or where an inner bore of the tool string is isolated from the annulus.

Figures 3, 4:
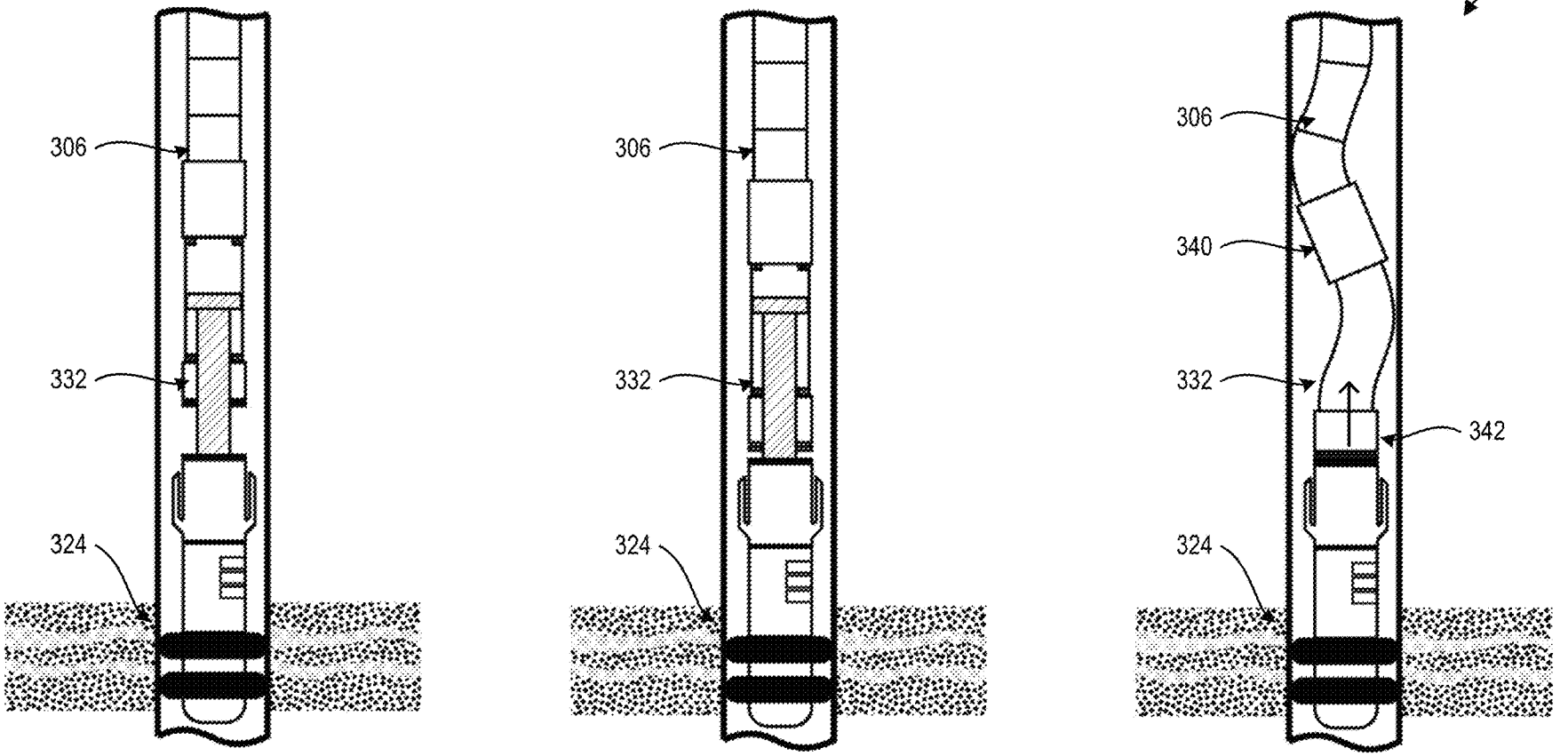
Figure 4:
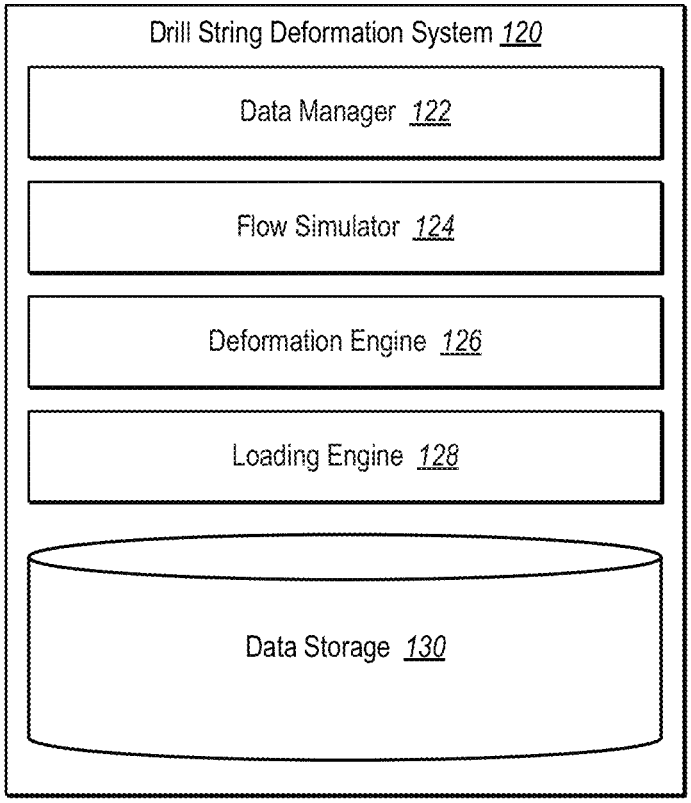

FIGS. 3-2 through 3-4 illustrate an example implementation 320 of a downhole testing operation. The example implementation 320 of FIGS. 3-2 to 3-4 may be an example of a formation testing operation, such as deep transient testing. Formation testing operations may be different than well testing operations, such as that described in connection with the example implementation 320 of FIG. 3-1. For example, well testing operations typically focus on assessing the well as a whole by testing the overall productivity, potential, and characteristics of the wellbore 302. As described above, this is achieved by sealing the wellbore 302 with the packer 324 and allowing the flow of formation fluids into, and up, the tool string 306. In contrast, the example implementation 320 (e.g., a formation testing or formation evaluation operation) is designed to obtain specific information about a specific target formation 310, such as reservoir pressure, rock permeability, formation fluid properties, reservoir boundaries, etc.

To achieve this, a formation evaluation tool 322 is typically lowered into the wellbore 302 to a specific depth of interest (e.g., depth of the formation 310 of interest) and fixed in place via a packer 324. The packer 324 may be the same type as the packer 304 of FIG. 3-1 or may be a different type of packer. The packer 324 typically is implemented as a two-part packer (or other suitable packer) for isolating (e.g., above and below) the formation 310 in order to isolate just the formation 310 of interest. This creates a sealed zone within the wellbore by straddling or encompassing the formation 310 with the packer 324.

The formation evaluation tool 322 may be lowered on a wireline, or as shown in FIG. 3-2, may also be conveyed as part of the tool string 306. During formation evaluation, formation fluids 328 are permitted to flow from the (e.g., sealed) formation 310 and into the formation evaluation tool 322, where sensors measure various parameters such as pressure, temperature, fluid composition, etc., directly from the formation 310. In some embodiments, the formation fluids 328 are released (e.g., flow) from the formation evaluation tool 322 into the annulus 314 above the packer 324. A drilling fluid 330, such as drilling mud or other downhole fluids (e.g., not necessarily associated with specifically drilling) is typically flowed (at one or more instances) down through the tool string 306 and out a port 326 of the tool string 306 near the end of the tool string 306. The port 326 may typically be positioned above the formation evaluation tool 322 and above the packer 324. The drilling fluid 330 in this way may fill the annulus 314 and flow back to the surface. The drilling fluid 330 may facilitate carrying the formation fluids 328 (e.g., oil and/or gas) to the surface. The drilling fluid 330 may also flow into and through the annulus 314 in this way for wellbore control, for example, to prevent the formation fluids 328 from flowing (e.g., freely and/or uncontrolled) to the surface.

Similar to the example implementation 300, or well testing operation, described above, the tool string 306 may experience deformation to varying degrees which may cause a length of the tool string 306 to change. For both formation testing and well testing operations, a top of the tool string 306 may also be axially fixed relative to the wellbore 302. For example, the downhole system may be equipped with a blow-out preventor (BOP) at or near the wellhead which may axially fix the tool string 306 at the surface or at an uphole end. Thus, with both ends of the tool string 306 axially constrained, changes in length of the tool string 306 may cause internal forces and stresses in the tool string 306, which may also apply forces on the associated packers of each situation (e.g., example implementations 300 and 320). The packer 304 in a well testing operation may tend to be a stronger, more robust packer capable of withstanding much higher compressive/tensile forces, for example, compared to the packer 324 of a formation testing operation. Thus, while the push/pull effect of the axial deformation of the tool string 306 may be an important consideration in well testing operations, the packer 304 may typically be equipped to handle these loads without moving the packer 304, and/or without damaging the packer 304, or the formation 310.

In contrast, the packer 324 implemented in formation testing operations may be different than those implemented in well testing operations. The packers 324 may be filled or inflated with the formation fluid 328, which may limit its strength and/or ability to withstand applied loads. In many cases, the packer 324 is set and/or fixed to an open portion of wellbore 302, for example, rather than being set/fixed within a casing of the wellbore 302. The packer 324 may typically not be as strong and robust as the packer 304 of a well testing operation. For example, the packer 324 of a formation evaluation operation may not be capable of withstanding the compressive/tensile forces to the same extent as the packer 304 of a well testing operation. This may result in the packer 324 moving, or worse, damaging the packer 324, the formation 310, or the formation evaluation tool 322 due to such applied loads. This may be undesirable for such reasons as affecting the quality or accuracy of the testing, or even resulting in catastrophic damage or failure of components of the downhole system. For example, damage of the packer 324 or the formation 310 and/or movement of the packer 324 may result in the packer 324 no longer isolating the formation 310, formation fluids 328 flowing up the wellbore 302, blowout, etc.

Accordingly, the example implementation 320 includes a slip joint 332 (or similar component) for connecting the formation evaluation tool 322 to the tool string 306. The slip joint 332 may be a component that may slide or actuate to accommodate changes in length of the tool string 306. The slip joint 332 may have a stroke, throw, or actuating length such that the slip joint 332 may extend or contract to a certain degree. The slip joint 332 may top out (or bottom out) after a given amount of deformation of the tool string 306. In this way, the slip joint 332 may accommodate a certain degree of deformation of the tool string 306, but may still result in tensile or compressive forces on the packer 324 if the slip joint 332 is extended or compressed too far.

Typically, the slip joint 332 may have a stroke length of less than 10 feet, such as 5-6 feet. The packer 324, tool string, etc. may also typically be set with the slip joint 332 at mid stroke in order to accommodate for a certain degree of deformation in either the compressive or expansive directions. Accordingly, the slip joint 332 may typically be implemented with only half of the stroke length available for a change in length of either direction. Thus, while the slip joint 332 may accommodate for some axial deformation of the tool string 306, in many cases, the slip joint 332 may not be suitable for accommodating all of the expansion or compression that a tool string 306 in a formation evaluation operation may experience. For example, in many situations, formation evaluation operations are conducted in wellbores and at formations that are located at significant depths within the earth, such as at 5000 m or greater, and in some cases, up to 10,000 m and deeper. These deep wellbores may exhibit significantly elevated temperatures which may cause a significant amount of thermal expansion (and correspondingly, thermal contraction when drilling fluid is circulated). This is exacerbated by the increased length of the tool string 306 contributing to a proportionately larger amount of deformation. Thus, in many cases, the changes in length of the tool string 306 may exceed the stroke length that the slip joint 332 may offer.

Additionally, implementing slip joints with longer stroke lengths, or implementing multiple slip joints may typically not be an option for remedying this problem. For example, a cable may be connected to the formation evaluation tool 322 and run through the tool string 306 to the surface to enable data and/or power communication with the formation evaluation tool 322. Changes in length (e.g., expansion) of the tool string 306 may cause tension and/or put stress on the cable. Accordingly, the cable may typically be secured or fixed at the surface such that the length of the cable corresponds with the tool string 306 and slip joint 332 at its longest length. Thus, when the slip joint 332 is positioned at less than full extension (either from being set as such or from the tool string deforming), a certain amount of slack may be present in the cable. In some implementations, too much slack in the cable may cause the cable to become pinched or crushed in the slip joint 332, for example, should the slip joint 332 reach full extension (e.g., as the tool string shortens in length). Thus, there is a practical limit to how much throw or stroke length the slip joint 332 may have without risking the cable becoming damaged as the slip joint 332 actuates. Similarly, it may not be practical to implement multiple slip joints (e.g., to achieve more stroke length), as the slack in the cable may still become pinched in one or more of the slip joints as the length of the tool string 306 decreases.

Accordingly, it may be advantageous to understand and characterize the deformation of the tool string 306, specifically in formation evaluation operations, in order to ensure that the stroke length of the slip joint 332 will not be exceeded, in order to ensure that excessive forces are not applied to the packer 324, and/or in order to implement one or more remedial actions to prevent failure or damage of the downhole system.

The tool string 306 in a formation evaluation operation may exhibit various forms or modes of deformation. In some cases, the tool string 306 may exhibit deformation in the form of thermal contraction, decreasing the length of the tool string 306. FIG. 3-3 illustrates the example implementation 320 exhibiting a decrease in the length of the tool string 306 to various degrees due to thermal contraction. Thermal contraction may occur due to the flow of drilling fluid through the tool string 306 cooling the tool string 306. The thermal contraction may result in tensile forces 340 within the tool string 306 when the limit of the slip joint 332 is reached, which may exert a pulling force on the packer 324.

In some cases, the tool string 306 may experience deformation in the form of thermal expansion, increasing the length of the tool string 306. FIG. 3-4 illustrates the example implementation 320 exhibiting an increase in the length of the tool string 306 to various degrees due to thermal expansion. Thermal expansion may be due to the elevated temperatures of the downhole environment (e.g., when the drilling fluid is not circulating). This thermal expansion may result in compressive forces 342 within the tool string 306 when the limit of the slip joint 332 is reached, which may exert a pushing force on the packer 324. Should thermal expansion continue past the point that the slip joint 332 may accommodate, the tool string 306 may experience further deformation in the form of helical buckling. Further, the tool string 306 may experience ballooning from the pressure differential between the pressure within the tool string and the anulus pressure.

In some embodiments, the tool string 306 of the formation evaluation operation may not exhibit one or more of the modes of deformation that a tool string in a well testing operation may exhibit. For example, the helical buckling in a formation evaluation situation may be due to the thermal expansion extending the length of the drill pipe, which, when fixed at both ends, may cause helical buckling. In contrast, the helical buckling of the well testing operation may be pressure-induced from the difference in pressure between the anulus and the inner bore of the tool string. Additionally, while the tool string 306 may experience ballooning, this may be to a lesser affect than that described for well testing, as the anulus and the inner tool string are not isolated in formation testing operations as they are in well testing operations. Further, the piston effect may be negligible in formation testing applications as the flow area change may be subtle at the end of the tool string 306. In this way, the tool string 306 may exhibit deformation in a way that is specifically applicable to formation evaluation operations for which conventional techniques for assessing deformation (e.g., in well testing operations) may not be equipped to accurately handle.

FIG. 4 illustrates an example implementation of the tool string deformation system 120 as described herein, according to at least one embodiment of the present disclosure. The tool string deformation system 120 may include a data manager 122, a flow simulator 124, a deformation engine 126, and a loading engine 128. The tool string deformation system 120 may also include a data storage 130 having various data stored thereon. While one or more embodiments described herein describe features and functionalities performed by specific components 122-128 of the tool string deformation system 120, it will be appreciated that specific features described in connection with one component of the tool string deformation system 120 may, in some examples, be performed by one or more of the other components of the tool string deformation system 120.

By way of example, one or more of the data receiving, gathering, or storing features of the data manager 122 may be delegated to other components of the tool string deformation system 120. As another example, while a flow simulator may simulate the tool string implemented in a wellbore and/or a flow of drilling fluid through the tool string, in some instances, some or all of these features may be performed by the deformation engine 126 (or other component of the tool string deformation system 120). Indeed, it will be appreciated that some or all of the specific components may be combined into other components, and specific functions may be performed by one or across multiple components 122-128 of the tool string deformation system 120.

Additionally, while FIG. 1, for example, depicts the tool string deformation system 120 implemented on a client device 112 of the downhole system, it should be understood that some or all of the features and functionalities of the tool string deformation system 120 may be implemented on or across multiple client devices 112 and/or server devices 114. For example, data may be input and/or received by the data manager 122 on a (e.g., local) client device, and tool string deformation may be determined and/or simulated on one or more of a remote, server, or cloud device. Indeed, it will be appreciated that some or all of the specific components 122-128 may be implemented on or across multiple client devices 112 and/or server devices 114, including individual functions of a specific component being performed across multiple devices.

As mentioned above, the tool string deformation system 120 includes a data manager 122. The data manager 122 may receive a variety of types of data associated with the downhole system and may store the data to the data storage 130. The data manager 122 may receive the data from a variety of sources, such as from sensors, surveying tools, downhole tools, other (e.g., client) devices, user input, etc.

In some embodiments, the data manager 122 receives temperature data. For example, the temperature data may indicate an environmental or wellbore temperature for one or more measurement depths of the wellbore. In some embodiments, the temperature data indicates a surface temperature. In some embodiments, the temperature data indicates a formation temperature, wellbore bottom temperature, or temperature associated with a location of a formation evaluation tool. In some embodiments, the temperature data indicates a temperature at one or more intermediate measurement depths of the wellbore. For example, the temperature data may indicate a temperature profile along the length (e.g., depth) of the wellbore. The temperature data may include measured data, estimated or simulated data, or combinations thereof. As described herein, in some embodiments, the temperature profile is determined based on a flow simulation of the flow simulator 124.

In some embodiments, the data manager 122 receives pressure data. For example, the pressure data may indicate an internal pressure, external pressure, or pressure differential of the tool string for one or more measurement depths. In some embodiments, the pressure data indicates a surface pressure. In some embodiments, the pressure data indicates a formation pressure, pressure at the bottom of the tool string, and/or pressure associated with a location of the formation evaluation tool. In some embodiments, the pressure data indicates a pressure at one or more intermediate measurement depths of the tool string. For example, the pressure data may indicate a pressure profile along a length (e.g., depth) of the wellbore. The pressure data may include measured data, estimated or simulated data, or combinations thereof. As described herein, in some embodiments, the pressure profile is determined based on a flow simulation of the flow simulator 124.

In some embodiments, the data manager 122 receives tool string data. The tool string data may indicate various physical properties of the tool string, such as a type, size, diameter, thickness, material/composition, geometry, or any other tool string property. The tool string data may indicate a number of lengths of pipe included in the tool string, a collection and/or makeup of various downhole tools within the tool string, an overall length of the tool string, an orientation, trajectory, inclination, azimuth, or orientation of the tool string. The tool string data may include information related to a formation evaluation tool connected to the tool string for implementing downhole. The tool string data may include information related to a slip joint of the tool string, such as a throw, stroke length, or actuation length of the slip joint. The tool string data may include information related to a packer for fixing the formation evaluation tool and/or tool string in place in the wellbore. For example, the tool string data may indicate an operational limit (e.g., force limit) for the packer to remain in place without damaging the packer, damaging the formation, and/or moving the packer. The tool string data may include any other information associated with the tool string and/or associated component implemented downhole.

In some embodiments, the tool string data includes wellbore data indicating various properties and characteristics of the wellbore. For example, the wellbore data may indicate a size, length, depth, geometry, trajectory, orientation, location, inclination, and/or azimuth of the wellbore. The wellbore data may indicate a formation of interest. For example, the formation may be fluid producing, and it may be of interest for testing with a formation evaluation tool. The wellbore data may indicate a depth of the formation. The formation data may indicate properties of the formation such as properties of the rock of the formation, properties of the fluid (e.g., pressure) of the formation, a size or capacity of the formation, etc. The wellbore data may include any other information associated with the wellbore, the subterranean materials and layer, and one or more formations.

In some embodiments, the tool string data includes drilling fluid data or mud data. The drilling fluid data may indicate a mud weight, viscosity, composition, or other properties of the drilling fluid. The drilling fluid data may indicate flow properties or rheological properties of the drilling fluid such as a flow rate and a pressure of the drilling fluid in the tool string at one or more (or all) measurement depths. The drilling fluid data may indicate heat transfer properties of the drilling fluid including a temperature of the drilling fluid. The drilling fluid data may indicate a fluid pumping rate and/or a mud rate of the drilling fluid, for example, conveyed via a pump at the surface.

In some embodiments, the data manager 122 receives user input. The data manager 122 may receive the user input, for example, via any of the client devices 112 and/or server devices 114. Any of the data described herein may be input or augmented via the user input. For example, in some instances, some or all of the data described herein is received by the data manager 122 as user input. The user input may be received in association with one or more functions or features of the tool string deformation system 120.

As mentioned above, the tool string deformation system 120 includes a flow simulator 124. The flow simulator 124 may simulate the tool string in the wellbore and may simulate a flow of the drilling fluid through the tool string. For example, the flow simulator 124 may perform or run a detailed simulation of the formation evaluation operation. For example, the flow simulator 124 may simulate the environmental conditions (pressures, temperatures, etc.) of the wellbore at the various measurement depths, may simulate a flow of formation fluids from the formation, etc.

In some embodiments, the flow simulator 124 determines one or more temperatures. For example, based on the simulation, the flow simulator may determine a temperature profile for the tool string. The temperature profile may identify the temperature of the tool string at one or more (or all) measurement depths of the tool string. The temperature profile may identify one or more changes in temperature that may occur throughout the duration of a formation evaluation operation. In some embodiments, the flow simulator 124 determines the temperature profile based on a measured temperature at the surface and a measured temperature at the formation evaluation tool. In some embodiments, the flow simulator 124 determines the temperature profile based on a measured temperature at the surface and an inferred or estimated temperature at the formation evaluation tool.

In some embodiments, the flow simulator 124 determines one or more pressures. For example, based on the simulation, the flow simulator may determine a pressure profile for the tool string. The pressure profile may identify the pressure within the tool string (e.g., a drilling fluid pressure) at one or more (or all) measurement depths of the tool string. The pressure profile may identify one or more changes in pressure that may occur throughout the duration of a formation evaluation operation. In some embodiments, the flow simulator 124 determines the pressure profile based on a measured pressure at the surface and a measured pressure at the formation evaluation tool. In some embodiments, the flow simulator 124 determines the pressure profile based on a measured pressure at the surface and an inferred or estimated pressure at the formation evaluation tool. In some embodiments, the flow simulator 124 determines the pressure profile based on the mud density of the formation fluid and based on a depth distribution of the mud. In some embodiments, the flow simulator 124 determines the pressure profile based on rheology and/or circulation data for the drilling fluid. In this way, the flow simulator 124 may determine a temperature profile and a pressure profile in order to facilitate determining the deformation of the tool string.

As mentioned above, the tool string deformation system 120 includes a deformation engine 126. The deformation engine 126 may determine a deformation of the tool string. For example, the deformation engine 126 may determine a change in length of the tool string based on one or more modes of deformation.

In some embodiments, the deformation engine 126 determines deformation of the tool string by accounting for thermal deformation, such as thermal contraction or thermal expansion of the tool string. When implemented in the wellbore, the temperatures of the downhole environment may cause the tool string to heat up, which may cause the tool string to lengthen due to thermal expansion. In some embodiments, the drilling fluid is pumped down through the tool string at a surface temperature which may be significantly cooler than the environmental temperature of the wellbore. The circulating mud may result in a significant cooling of the tool string and/or the wellbore. This may result in the shortening of the tool string due to thermal contraction. In some cases, thermal contraction may account for a significant part of the overall deformation of the tool string. In some cases, the drilling fluid is caused to stop flowing through the tool string, which if left for long enough, may cause the tool string and/or the wellbore to warm back up to an equilibrium temperature, resulting in thermal expansion of the tool string, at least partly back to a pre-compressed length.

In some embodiments, the deformation engine 126 represents the thermal deformation along the tool string based on the following formula:

$$\Delta L_1 = \int_0^L \alpha \Delta T dl$$

Or in discretized form:

$$\Delta L_1 = \sum_{i=1}^{n} \alpha \Delta T_i l_i$$

Where:

L is the length of the tool string, $\Delta L_1$ is the change in length due to thermal deformation, $\alpha$ is the thermal expansion coefficient of the tool string, and $\Delta T$ is the temperature difference.

In this way the deformation engine 126 may account for thermal deformation of the tool string due to changes in temperature along the tool string. The deformation engine 126 may determine thermal deformation in any other way and/or according to any other formula.

In some embodiments, the deformation engine 126 determines deformation of the tool string by accounting for ballooning (or reverse ballooning) of the tool string. For example, the pressure difference between the inside and the outside of the tool string may cause the tool string to deform in a transverse direction. A larger inner pressure on the tool string resulting in expansion in the transverse direction (ballooning) may cause a shortening of the tool string in the axial direction. Conversely, a larger outer pressure on the tool string may result in compression in the transverse direction (reverse ballooning) which may cause a lengthening of the tool string in the axial direction.

In some embodiments, the deformation engine 126 represents the ballooning (or reverse ballooning) deformation of the tool string based on the following formula:

$$\Delta L_2 = \frac{vL}{Et}\left(R_o \Delta P_o(z)_{average} - R_i \Delta P_i(z)_{average}\right)$$

Where:

$\Delta L_2$ is the change in length due to ballooning/reverse ballooning deformation, v is Poisson's ratio of the tool string, E is Young's modulus of the tool string, t is the thickness of the tool string, $R_o$ is the outer radius of the tool string, $R_i$ is the inner radius of the tool string, $\Delta P_o(z)_{average}$ is the outside average pressure, and and $\Delta P_i(z)_{average}$ is the inside average pressure.

In this way, the deformation engine 126 may account for deformation of the tool string due to ballooning of the tool string. The deformation engine 126 may determine ballooning deformation in any other way and/or according to any other formula.

In some embodiments, the deformation engine 126 determines deformation of the tool string by accounting for helical buckling of the tool string. In some embodiments, the deformation engine 126 considers helical buckling in a different way than that described above in association with well evaluation operations. For example, helical buckling for a formation evaluation operation may not be pressure-induced, as the end of the drill pipe is not sealed/isolated from the anulus, and the pressure difference between the inside and outside of the drill pipe may not be significant enough to cause helical buckling in this way. Rather, helical buckling may occur due to the thermal expansion of the tool string and by virtue of both ends of the tool string being fixed (e.g., after the limit of the slip joint is reached).

In some embodiments, the deformation engine 126 represents helical buckling of the tool string based on the following formula:

$$\Delta L_{helical} = -\frac{r_w^2 F^2}{8EIw}$$

Where:

$\Delta L_{helical}$ is the change in length when helical buckling occurs, $r_w$ is the radius of the wellbore, F is the force acting at the bottom of the tool string, I is moment of inertia of tool string cross-section area with respect to its diameter, and w is the weight of tool string per unit length.

In this way, the deformation engine 126 may account for deformation of the tool string due to helical buckling of the tool string. The deformation engine 126 may determine helical buckling deformation in any other way and/or according to any other formula.

In this way, the deformation engine 126 may determine various modes of deformation of the tool string based on the temperature and pressure profiles determined by the flow simulator 124. The deformation engine 126 may determine a total deformation for the tool string by incorporating and/or accounting for one or more (or all) of these modes of deformation. For example, before the compensation limit of the slip joint is reached, the deformation engine 126 may determine the total deformation according to the following formula:

$$\Delta L_{total} = \Delta L_1 + \Delta L_2$$

Where:

$\Delta L_1$ is the change in length due to thermal deformation, $\Delta L_2$ is the change in length due to ballooning, When the slip joint is operating within its stroke length, no helical deformation will occur, and accordingly, helical deformation may not be accounted for in the determination of the total deformation.

In some embodiments, the deformation of the tool string may cause the slip joint to reach the compensation limit. The tool string may be constrained against further deformation due to the tool string being fixed at both ends. Thus, the effects that would otherwise cause the further compression or expansion of the tool string may be exhibited as inner forces within the tool string. This may occur in two scenarios: when the tool string contracts to a furthest (e.g., upper) extent of the stroke of the slip joint, and when the tool string expands to a furthest (e.g., lower) extent of the stroke of the slip joint.

As mentioned above, the tool string deformation system 120 includes a loading engine 128. The loading engine 128 may determine the inner forces within the tool string resulting from the compressive or expansive effects of the tool string past the compensation limit of the slip joint.

For example, in the case of excessive contraction, no helical buckling would occur. Thus, the total length is constrained by the contractive (e.g., uphole) limit of the slip joint, and an internal tensile force would result within the tool string. The loading engine 128 may determine this tensile force according to the following formula:

$$F_{tensile} = \frac{\Delta L_1 + \Delta L_2 - C_{s1}}{L} EA$$

Where:

$\Delta L_1$ is the change in length due to thermal deformation, $\Delta L_2$ is the change in length due to ballooning, $C_{s1}$ is the slip-joint compensation limit for contraction, or the total stroke length of the slip joint in the contraction direction, E is Young's Modulus of the tool string A is the cross-section area of the tool string wall.

In the case of excessive expansion, the total length change is again constrained by the compensation limit (e.g., in the expansive direction), and an internal compressive force would result within the tool string. However, further expansion could still occur and would instead result in helical buckling. Thus, in order to accurately determine the internal compressive force, the loading engine may account for helical buckling. When the compensation limit for expansion is consumed, the loading engine 128 may represent the further expansion of the tool string according to the following formula:

$$\Delta L_{helical} = \Delta L_1 + \Delta L_2 - C_{s2}$$

Where:

$\Delta L_{helical}$ is the change in length when helical buckling occurs, $\Delta L_1$ is the change in length due to thermal deformation, $\Delta L_2$ is the change in length due to ballooning, and $C_{s2}$ is the slip joint compensation limit for expansion, or the total stroke length of the slip joint in the expansive direction.

Thus, the compressive force may be determined by combining this formula with the formula for helical buckling described above:

$$F_{compression} = \sqrt{\frac{8EIw(\Delta L_1 + \Delta L_2 - C_{s2})}{r_w^2}}$$

In some embodiments, the loading engine 128 accounts for friction of the slip joint when determining the internal force of the tool string and the deformation of the tool string. This determination and incorporation of friction of the slip joint may be applicable to the scenario when the slip joint is operating within the stroke length.

For example, the loading engine 128 may determine a theoretical force of deformation resulting from the length change of the tool string according to the following formula:

$$F_{deform} = \frac{\Delta L_{total}}{L} EA$$

If this theoretical force is smaller than the frictional force of the slip joint, then the drill pipe would not deform. If the theoretical force is larger than the frictional force of the slip joint, then the tool string may begin to deform, and the internal force would be equal to the frictional force. Accordingly, the total deformation and the internal force of the drill pipe (e.g., when the slip joint is operating within the stroke length) may be represented by the following formulas:

$$\text{if } F_{deform} \le F_f, \text{ then } \Delta L^a_{total} = 0,\ F^a_{internal} = F_{deform}$$

$$\text{if } F_{deform} > F_f, \text{ then } \Delta L^a_{total} = \Delta L_{total} - L_{history},\ F^a_{internal} = F_f$$

Where:

$$\Delta L^a_{total}$$

is the corrected drill pipe deformation, $L_{history}$ is the corrected length considering the deformation history, $F_f$ is the frictional force of the slip-joint, and $$F^a_{internal}$$

is the corrected internal force of the drill pipe.

In this way, the loading engine 128 may determine the internal compressive or tensile force of the tool string when the slip joint is operating within the stroke length, as well as when the compensation limit of the slip joint is met.

In some embodiments, the loading engine 128 may determine whether the internal force of the tool string will approach, meet, or exceed one or more operational limits of the downhole system. For example, the tool string may have one or more failure limits of the components of the tool string, and the loading engine 128 may identify when those failure limits are met or exceeded by the internal force. In some embodiments, the loading engine 128 may identify that the internal force will surpass an operational limit of the packer. For example, the inner force of the tool string may exert or apply a corresponding push or pull force on the packer. This may pose a risk of causing the packer to move, or may damage the packer, the formation, or the formation evaluation tool. The loading engine 128 may identify that the deformation of the tool string may cause such a limit to be reached. In some embodiments, the loading engine 128 may indicate, for example, to a user of the tool string deformation system 120 of the excessive tool string internal force via an alert or flag.

While the tool string deformation system 120 has been described with respect to a formation evaluation operation, and with respect to a tool string, packer, slip joint, etc. implemented in a wellbore, it should be understood that this is merely illustrative of the applicability of the functionalities of the tool string deformation system 120 to a formation evaluation operation. For example, in some embodiments, the tool string deformation system 120 may be implemented as part of a simulation, planning, and/or potential implementation of the tool string for the purposes of formation evaluation. For instance, some or all of the data may be simulated, estimated, or approximated in order to evaluate how a downhole system may behave in a potential or future formation evaluation operation. In some embodiments, the tool string deformation system 120 may be implemented as part of a current, active, and/or real time formation evaluation operation. In this way the tool string deformation system 120 may be applicable to a wide range of implementations, both simulated and actual.

In some embodiments, the tool string deformation system 120 may incorporate one or more assumptions in order to achieve the features and functionalities described herein. For example, one or more of the features of one or more of the flow simulator 124, deformation engine 126, or loading engine 128 may incorporate one or more assumptions in order to model the dynamics of the downhole system. For example, the tool string deformation system 120 may represent the drill pipe as being composed of an isotropic material. The tool string deformation system 120 may represent the deformation of the tool string as remaining in the elastic deformation region. The tool string deformation system 120 may represent the strain-displacement relationship as linear. The tool string deformation system 120 may represent the interaction between the drill pipe and the wellbore as being frictionless or negligible. For example, the tool string deformation system 120 may evaluate the tool string deformation for cases of a vertical well, for example, having little to no contact between the tool string and the wellbore. The tool string deformation system 120 may represent the interaction of the drilling fluid (and/or the formation fluid) with the tool string as being frictionless or negligible. The tool string deformation system 120 may represent the tool string as a thin-walled structure. For example, the temperature variation or gradient inside the steel wall of the tool string may be presumed to be negligible. The tool string deformation system 120 may incorporate any other assumption, or may omit one or more of these assumptions in performing any of the functionalities described herein.

In some embodiments, the tool string deformation system 120 may implement one or more of the features and/or may incorporate one or more of the formulas mentioned above with respect to a deviated wellbore. For example, for deviated wellbores, the tool string deformation system 120 may consider the bending effects of the tool string and/or friction between the wellbore and tool string. In some cases, the loading engine 128 may consider and/or incorporate these effects when determining the tool string deformation and inner forces within the tool string. For example, the loading engine 128 may determine deformation according to the following formulas:

$$\varepsilon_{rr} = \frac{1}{E}[\sigma_{rr} - \nu(\sigma_{\theta\theta} + \sigma_{zz})] + \alpha\Delta T$$

$$\varepsilon_{\theta\theta} = \frac{1}{E}[\sigma_{\theta\theta} - \nu(\sigma_{rr} + \sigma_{zz})] + \alpha\Delta T$$

$$\varepsilon_{zz} = \frac{1}{E}[\sigma_{zz} - \nu(\sigma_{\theta\theta} + \sigma_{rr})] + \alpha\Delta T$$

$$\gamma_{ij} = \frac{E}{2(1+\nu)}\tau_{ij} \quad i \neq j$$

Where:

$\varepsilon$ is the strain, $\sigma$ is the normal stress $\tau$ is the shear stress E is the Young's modulus $\nu$ is the Poisson's ratio, and $\alpha\Delta T$ is the thermal strain induced by the temperature change.

In some embodiments, the loading engine 128 may implement finite element analysis techniques for determining the deformation of the tool string, for example, based on these (or other) equations. For example, the loading engine 128 may determine and implement boundary conditions based on the trajectory of the wellbore and the configuration (e.g., tools, geometry) of the tool string. In this way, the present techniques may be adapted to apply to both vertical and deviated wellbores.

In some embodiments, one or more of the features of the flow simulator 124, the deformation engine 126, and/or the loading engine 128 may be performed by a machine learning model. For example, a machine learning model may be trained based on the drilling fluid flow data to determine the corresponding temperature and/or pressure profiles. In another example, a machine learning model may be trained based on an input of the temperature and pressure profiles to determine a corresponding force that the packer may experience due to deformation of the tool string. The internal tension (or compression) on the tool string may be measured, for example, by a sensor on the tool string, which may be provided as a ground truth for training the model to predict the force based on the temperature and pressure inputs. In this way, while the example formulas described above may provide a useful model of the tool string in order to predict deformation, the tool string deformation system 120 may be implemented with a machine learning model to predict the tool string internal force based on supervised learning. This may facilitate a more complete, robust, accurate, and/or precise characterizing of the tool string by training a machine learning model to output a prediction of the forces.

Figure 5:
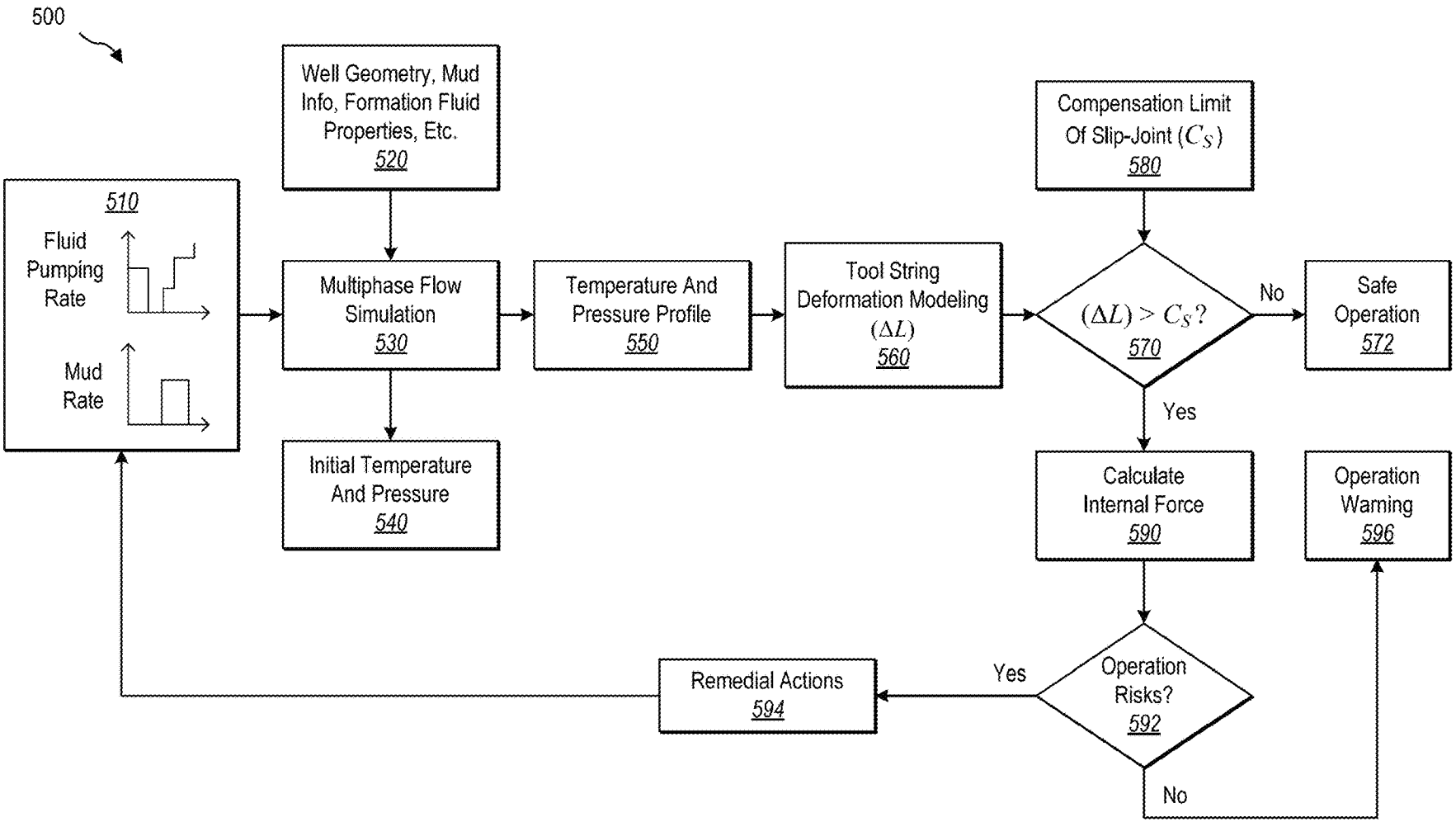
FIG. 5 illustrates an example workflow of a tool string deformation system as described herein, according to at least one embodiment of the present disclosure.

FIG. 5 illustrates an example workflow 500 of the tool string deformation system 120 as described herein, according to at least one embodiment of the present disclosure. The workflow 500 may be representative of a planning phase of a formation evaluation operation.

As described herein, a temperature and pressure profile 550 may be determined for a tool string based on a flow simulation 530. The flow simulation 530 may be based on various inputs 520, such as wellbore properties, tool string properties, mud properties, formation fluid properties etc. The flow simulation 530 may begin with an initial temperature and pressure 540, which may be a measured (or simulated) temperature and pressure at the surface. Based on an operation schedule 510 for the drilling fluid (e.g., fluid pumping rate, mud rate) the flow simulation 530 may determine the temperature and pressure profiles 550 along the length of the tool string for various time intervals of a formation evaluation operation. A tool string deformation model 560 may be applied to the temperature and pressure profiles 550 to determine the deformation of the tool string. Based on the compensation limit 580 of the slip joint, the tool string deformation system 120 may evaluate, at 570, whether the compensation limit 580 of the slip joint is reached, and the tool string deformation system 120 may determine whether the formation evaluation operation poses any operational risks. For example, if the slip joint compensation limit 580 is reached, the tool string deformation system 120 may determine the associated internal forces 590 of the tool string and may determine whether, and to what extent, an operational limit of one or more components will be reached, such as a push or pull limit of the packer. If the slip joint compensation limit 580 is not reached, the tool string deformation system 120 may determine that the operation is safe, at 572. In this way, the tool string deformation system may be implemented as a planning tool to evaluate how a formation evaluation operation will perform, and to tailor the implementation of the operation such that testing may be successful and/or the downhole system may not experience damage.

In some cases, the tool string deformation system 120 may indicate that the tool string may experience excessive deformation and that the internal tool string forces may exceed operational thresholds. Accordingly, the operation may be indicated as presenting a high operational risk 592. In some embodiments, the tool string deformation system 120 may facilitate determining one or more remedial actions 594 for affecting and/or modifying the operation in order to bring the tool string deformation to within an allowable range. For example, the tool string deformation system 120 may indicate that one or more operational parameters may need to be adjusted, such as adjusting the operation schedule for the flow of the drilling fluid through the tool string. This may accordingly influence the effect to which the tool string may experience thermal deformation. For example, by lowering the flow rate of the drilling fluid through the drill pipe, the drilling fluid may have less of a cooling effect on the tool string, which may cause less thermal expansion. In this way, the circulation rate of the drilling fluid may be adjusted in order to prevent excessive force on the packer. However, there may be a functional and/or practical limit to the extent to which the circulation rate may be adjusted. For example, one function of flowing the drilling fluid into the drill pipe is for well control purposes, as the drilling fluid in the anulus may function to limit or prevent the flow of the production fluids up the wellbore. A certain balance of the drilling fluid to formation fluid must accordingly be maintained in the anulus to control the flow of the formation fluids. Thus, in some cases, while slowing the circulation of the drilling fluid may help to reduce contraction of the tool string, in some cases it may not be desirable, or possible to slow the circulation of the drilling fluid to or past a certain extent.

In some embodiments, the tool string deformation system 120 may facilitate determining and implementing one or more other remedial or preventative actions that may be taken to adjust the deformation of the tool string. This may be in addition to or in place of altering the flow of the drilling fluid through the tool string.

In some cases, it may be possible and/or desirable to cause some degree of thermal expansion or contraction of the tool string prior to fixing one or both ends of the tool string (e.g., prior to installing or fixing the packer, prior to fixing or closing the BOP, or both). For example, based on the planning workflow discussed above, the tool string deformation system 120 may indicate that, for a given formation evaluation operation with certain operational, environmental, and wellbore conditions, etc., a deformation of the tool string may exceed the compensation limits of the slip joint, resulting in excessive force on the packer. In such a case, it may otherwise be determined that such an operation may not be possible or desirable for implementation. However, the thermal contraction of the tool string may be leveraged to intentionally shorten the tool string prior to installing the packer in order to "pre-contract" the tool string. For example, after the tool string, packer, slip-joint, etc. is tripped into the wellbore, and before fixing the packer, drilling fluid may be flowed through the tool string in order to cause at least some of the cooling of the tool string that would otherwise have occurred during the formation evaluation operation. In this way, some or all of the thermal contraction of the tool string may be effectuated before the packer is fixed, and the throw of the slip joint may not have to be used to accommodate the pre-contracted shortening of the tool string. In this way, the some or all of the tool string may be intentionally thermally contracted prior to installing the packer such that any further thermal contraction of the tool string after the packer is fixed may fall within the stroke length of the slip joint. This same technique may be implemented with respect to the fixing or closing of the BOP at the uphole end of the tool string. Similarly, this technique may be implemented in connection with pre-expanding, or allowing for a given amount of thermal expansion, of the tool string prior to fixing one or both ends of the tool string.

The tool string deformation system 120 may facilitate this remedial and/or preventative action, for example by determining to what extent the tool string needs to be pre-contracted (or pre-expanded), and also by determining how to achieve the desired length of contraction/expansion. For example, the tool string deformation system 120 may be implemented to simulate a pre-contracting operation in order to determine how much the tool string will shorten, and what operational parameters (e.g., mud flow rates etc.) to implement in order to achieve the desired change in length.

In another example, the determination of the change in length of the tool string by the pre-planning workflow discussed above may be leveraged in order to determine a set point of the slip joint. For example, as discussed above, slip joints are typically set at a midpoint (or thereabout) of the stroke length in order to allow for a maximum (e.g., and equal) throw of the slip joint in both compressive and expansive directions. However, the tool string deformation system 120 may facilitate tailoring the setpoint of the slip joint to better accommodate the expected changes in length of the tool string. For example, the pre-planning workflow discussed above may indicate that, during a given formation evaluation operation, the tool string may experience more compression than expansion. Accordingly, a set point of the slip joint may be set with a longer stroke length in the compressive direction and a shorter stroke length in the expansive direction. In other examples, the opposite may be applicable with the slip joint being set to allow for more expansion and less compression. In this way, a formation evaluation operation that may otherwise have been indicated as a high operational risk due to the compensation limit of the slip joint being reached may nevertheless be performed based on the tool string deformation system facilitation tailoring the setpoint of the slip joint. In some embodiments, any combination of the remedial and/or preventative actions may be implemented together in order to achieve a desired (e.g., reduced) deformation during a formation evaluation operation.

In some cases, the tool string deformation system 120 may determine that the deformation of the tool string does not pose an operational risk 592, such as by not exceeding the compensation limit 580 of the slip joint. In some cases, the tool string deformation system 120 may generate and/or present an operational warning 596 in order to note or log the determined deformation and/or internal forces, for example, without proceeding to determine and/or implement one or more remedial actions 594.

In this way, the tool string deformation system 120 may facilitate determining whether a given formation evaluation operation may successfully and safely be completed, as well as facilitating determining how to complete operations that may otherwise not have been determined to be possible. This may facilitate performing formation evaluation operations in wellbores and at formations that are located deeper within the earth, and/or exhibit higher temperatures. For example, as discussed herein, deep wellbores (e.g., in excess of 5000 meters) may present challenges for formation evaluation operations in that the elevated temperatures and longer tool strings may result in much more deformation. By implementing the prediction and remediation techniques facilitated by the tool string deformation system, these deeper wellbores may now be accessible for formation evaluation operations.

Figure 6:
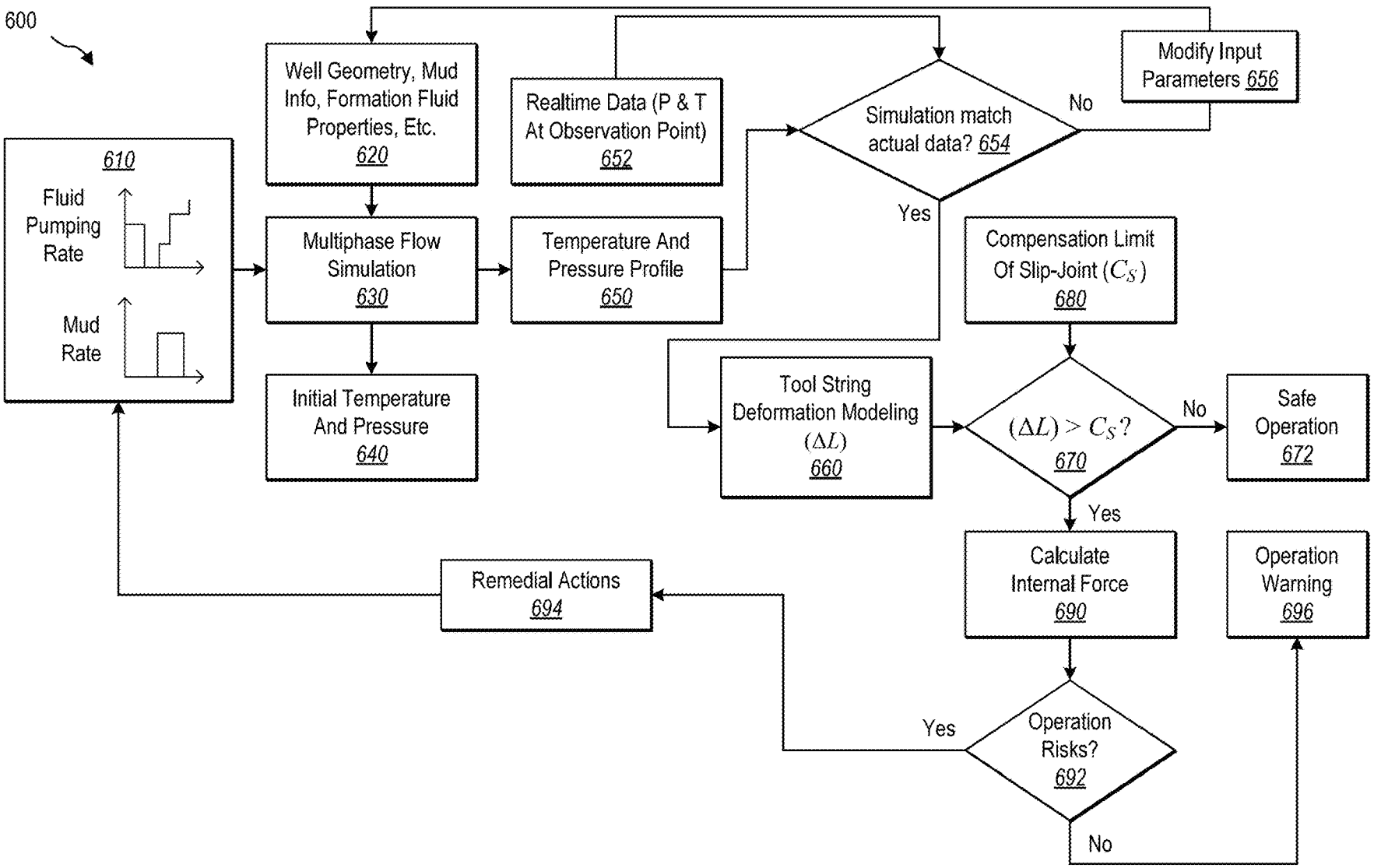
FIG. 6 illustrates an example workflow of a tool string deformation system as described herein, according to at least one embodiment of the present disclosure.

FIG. 6 illustrates an example workflow 600 of the tool string deformation system 120 as described herein, according to at least one embodiment of the present disclosure. The workflow 600 may be representative of an actual, current, and/or real-time implementation of the tool string deformation system as described herein. For example, as discussed above, the tool string deformation system 120 may be implemented to predict, as a planning tool, the deformation and/or forces of a tool string in association with a given formation evaluation operation. The workflow 600 may include one or more of the features of the workflow 500, and may incorporate one or more actual and/or real-time measurement values. For example, a flow simulation 630 may be performed based on inputs 620, initial temperature and pressure values 640, and an operation schedule 610 to determine simulated temperature and pressure profiles 650.

In some embodiments, the planned operation may be implemented by a downhole system, for example, based on the pre-planning workflow discussed above, indicating that the operation may be possible and/or successful. The workflow 600 may be implemented as a validation of the pre-planned predictions based on actual values measured during the formation evaluation operation.

For example, as mentioned, the flow simulation 630 may be applied to initial temperature and pressure values 640 to generate simulated temperature and pressure profiles 650 for the tool string. During the actual operation, measured (e.g., real time) temperature and pressure values 652 along the tool string may be taken and compared to, at 654, the simulated temperature and pressure profiles 650. If the simulated temperature and pressure profiles 650 match (or are sufficiently close to) the measured values 652, the tool string deformation system 120 may indicate that the predicted outcomes of the operation (e.g., deformation and forces) are accurate and still applicable, and may proceed with implementing a tool string deformation model 660 to predict deformation of the tool string. However, in the event of a disagreement between the measured values 652 and simulated temperature and pressure profiles 650, the tool string deformation system 120 may indicate that a predicted deformation may be inaccurate and may no longer reflect the expected deformation and forces that the tool string may exhibit. Accordingly, the tool string deformation system 120 may proceed by implementing the tool string deformation model 660 with the measured values 652 in order to determine updated and/or more accurate predictions that may more accurately reflect what may be expected for the current formation evaluation operation. In some embodiments, the tool string deformation system 120 may modify, at 656, one or more of the inputs 620 in order that the simulated temperature and pressure profile 650 is determined with a higher accuracy with regard to the measured values 652.

Once the tool string deformation system 120 has determined suitable temperature and pressure information (e.g., utilizing the simulated temperature and pressure profile 650 after determining its accuracy, utilizing the measured temperature and pressure values 652, and/or updating the flow simulation 630 to generate updated and accurate simulated temperature and pressure profiles 650), the tool string deformation system 120 may implement the tool string deformation model 660 to predict tool string deformation, internal forces etc., as described above in connection with FIG. 5. For instance, the tool string deformation system 120 may determine, at 670, whether the tool string deformation exceeds a compensation limit 680 of the slip joint, may calculate internal forces 690, and may determine whether the deformation and/or internal forces pose an operational risk 692. The tool string deformation system 120 may determine that the operation is safe at 672 based on the deformation being within a tolerable limit, may determine that there is not operational risk and present an operation warning 696, or else may provide one or more remedial actions 694.

In this way, the tool string deformation system 120 may be implemented as a planning tool, and may also be validated and/or updated as the actual formation evaluation operation is implemented. In some embodiments, the deformation and/or force predictions may be updated in real time based on real time measurements of temperature and/or pressure.

Figure 7:
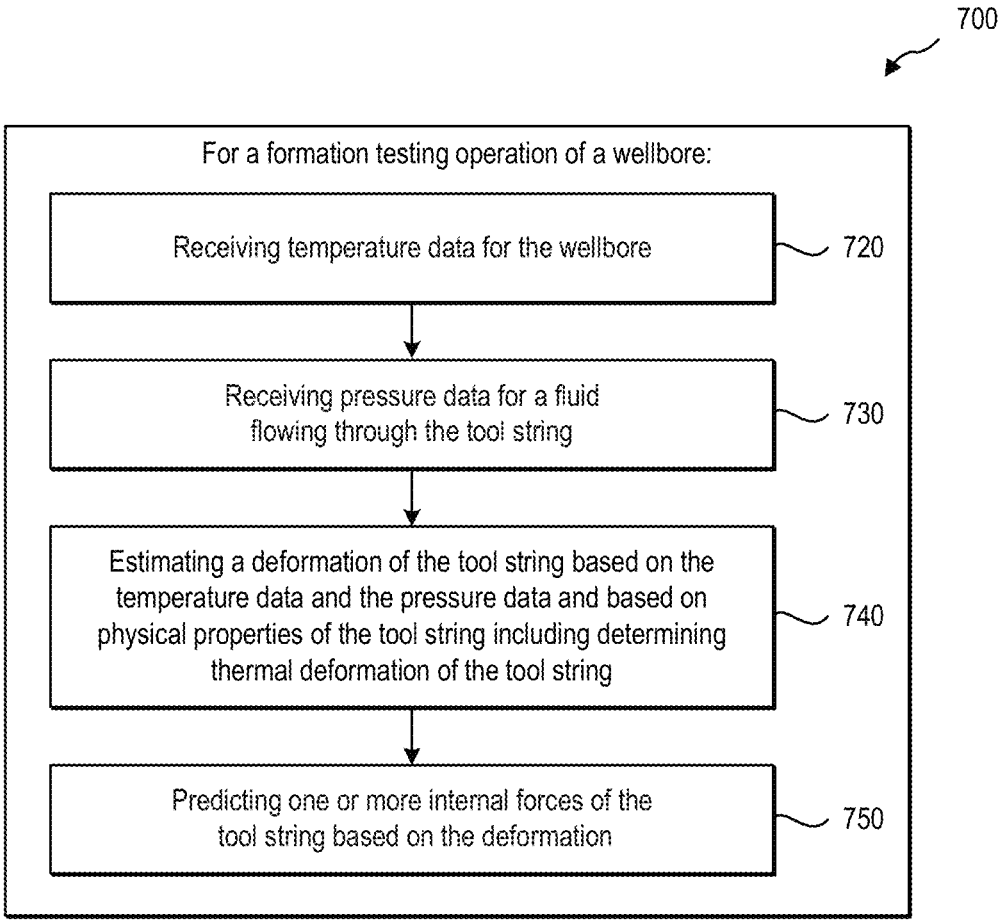
FIG. 7 illustrates a flow diagram for a method or a series of acts for predicting loading of a tool string implemented in a wellbore as described herein, according to at least one embodiment of the present disclosure.

FIG. 7 illustrates a flow diagram for a method 700 or a series of acts for predicting loading of a tool string implemented in a wellbore as described herein, according to at least one embodiment of the present disclosure. While FIG. 7 illustrates acts according to one embodiment, alternative embodiments may add to, omit, reorder, or modify any of the acts of FIG. 7.

In some embodiments, the method includes an act of performing one or more sub acts for a formation testing operation of a wellbore. The sub acts may include any of the acts 720-750. For example, the method 700 may include an act 720 (e.g., sub act) of receiving temperature data for the wellbore. The method 700 may include an act 730 (e.g., sub act) of receiving pressure data for a fluid flowing through the tool string. The method 700 may include an act 740 (e.g., sub act) of estimating a deformation of the tool string based on the temperature data and the pressure data and based on physical properties of the tool string. Estimating the deformation may include determining thermal deformation of the tool string. The method 700 may include an act 750 (e.g., sub act) of predicting one or more internal forces of the tool string based on the deformation. In some embodiments, the method 700 may be performed by a computer system. In some embodiments, the method 700 may be performed by a processor executing instructions stored on a computer-readable storage medium.

Figure 8:
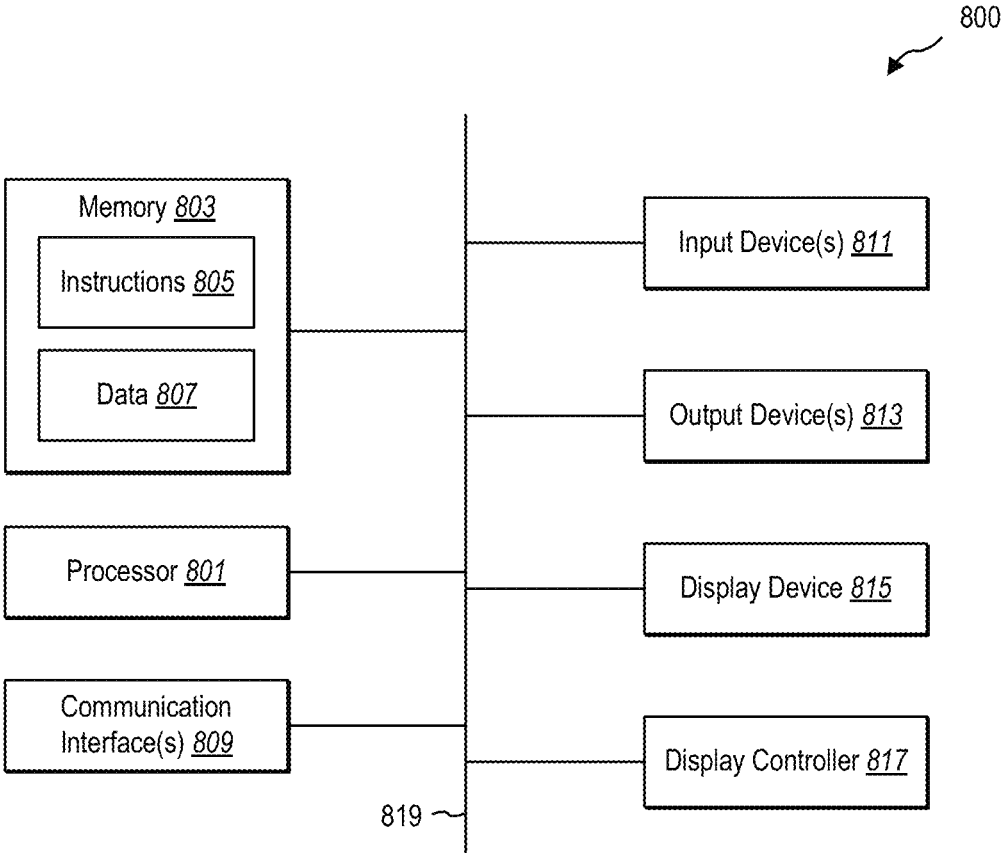
FIG. 8 illustrates certain components that may be included within a computing system.

Turning now to FIG. 8, this figure illustrates certain components that may be included within a computer system 800. One or more computer systems 800 may be used to implement the various devices, components, and systems described herein.

The computer system 800 includes a processor 801. The processor 801 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 800 of FIG. 8, in an alternative configuration, a combination of processors (e.g., an ARM and DSP) could be used.

The computer system 800 also includes memory 803 in electronic communication with the processor 801. The memory 803 may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions 805 and data 807 may be stored in the memory 803. The instructions 805 may be executable by the processor 801 to implement some or all of the functionality disclosed herein. Executing the instructions 805 may involve the use of the data 807 that is stored in the memory 803. Any of the various examples of modules and components described herein may be implemented, partially or wholly, as instructions 805 stored in memory 803 and executed by the processor 801. Any of the various examples of data described herein may be among the data 807 that is stored in memory 803 and used during execution of the instructions 805 by the processor 801.

A computer system 800 may also include one or more communication interfaces 809 for communicating with other electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 809 may connect the computer system 800 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instructions or data structures and which may be accessed by a general purpose or special purpose computer.

A computer system 800 may also include one or more input devices 811 and one or more output devices 813. Some examples of input devices 811 include a keyboard, mouse, microphone, remote control device, button, joystick, trackball, touchpad, and lightpen. Some examples of output devices 813 include a speaker and a printer. One specific type of output device that is typically included in a computer system 800 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into one or more of text, graphics, or moving images (as appropriate) shown on the display device 815.

The various components of the computer system 800 may be coupled together by one or more buses, which may include one or more of a power bus, a control signal bus, a status signal bus, a data bus, other similar components, or combinations thereof. For the sake of clarity, the various buses are illustrated in FIG. 8 as a bus system 819.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

INDUSTRIAL APPLICABILITY

The following description from ¶¶ [0104]-[0176] includes various embodiments that, where feasible, may be combined in any permutation. For example, the embodiment of ¶ [0104] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method of predicting loading of a tool string implemented in a wellbore, comprising for a formation testing operation of the wellbore receiving temperature data for the wellbore, receiving pressure data for a fluid flowing through the tool string, estimating a deformation of the tool string based on the temperature data and the pressure data and based on physical properties of the tool string including determining thermal deformation of the tool string.

In some embodiments, predicting one or more internal forces of the tool string is based on the deformation.

In some embodiments, in the formation testing operation, a packer is fixed in the wellbore to isolate a formation from the wellbore.

In some embodiments, the tool string is connected to the packer.

In some embodiments, the packer includes an upper packer and a lower packer positioned such that an interval of interest of the formation is between the upper packer and lower packer.

In some embodiments, the tool string is connected to the packer such that the tool string is constrained to limited axial movement.

In some embodiments, the tool string includes a downhole tool positioned within the formation such that a formation fluid flows into the downhole tool.

In some embodiments, the formation fluid flows into the downhole tool between the upper packer and the lower packer.

In some embodiments, the formation fluid flows out of the downhole tool and into the wellbore above the packer.

In some embodiments, the fluid flows from the surface down through the tool string to prevent a flow of the formation fluid up through the wellbore.

In some embodiments, the packer is fixed in the wellbore based on filling the packer with a fluid to inflate the packer.

In some embodiments, the packer is fixed to an open hole interval of the open wellbore.

In some embodiments, in the formation testing operation, the tool string is fixed to the surface.

In some embodiments, the tool string includes a downhole tool axially fixed in the wellbore.

In some embodiments, the downhole tool is connected to the tool string with a constrained slidable connection.

In some embodiments, the constrained slidable connection is a slip joint.

In some embodiments, the constrained slidable connection has a stroke length of less than 10 feet.

In some embodiments, estimating the deformation includes determining a stroke position of the constrained slidable connection.

In some embodiments, predicting the one or more internal forces includes determining that the stroke of the constrained slidable connection is at a maximum extent.

In some embodiments, the downhole tool is connected to the surface via a cable disposed within a central bore of the tool string.

In some embodiments, the cable passes through an inner bore of the constrained slidable connection.

In some embodiments, the temperature data includes a temperature profile along one or more of a point of, a plurality of points along, a portion of, or the entirety of the length of the wellbore.

In some embodiments, the temperature profile is determined based on a surface temperature and/or a downhole temperature.

In some embodiments, the surface temperature is a measured surface temperature.

In some embodiments, the downhole temperature is an estimated downhole temperature.

In some embodiments, the temperature profile is determined based on a temperature simulation of the wellbore based on the surface temperature and/or the downhole temperature.

In some embodiments, the pressure data includes a pressure profile of the fluid along one or more of a point of, a plurality of points along, a portion of, or the entirety of the length of the tool string.

In some embodiments, the pressure profile is determined based on a surface pressure and/or a downhole pressure.

In some embodiments, the surface pressure is a measured surface pressure.

In some embodiments, the downhole pressure is an estimated downhole pressure.

In some embodiments, the pressure profile is determined based on a pressure simulation of the wellbore based on the surface pressure and/or the downhole pressure.

In some embodiments, the pressure profile is further determined based on a fluid density of the fluid and a range of depths of the tool string.

In some embodiments, the pressure profile is further determined based on rheology data of the fluid flowing through the tool string.

In some embodiments, the fluid is drilling mud.

In some embodiments, the thermal deformation includes thermal contraction of the tool string based on the tool string being at least partially cooled by the flow of the fluid.

In some embodiments, the thermal deformation includes thermal expansion of the tool string based on a downhole temperature heating the tool string.

In some embodiments, the thermal deformation causes a stroke of the slip joint to move and/or predicting the one or more internal forces includes accounting for the movement of the stroke of the slip joint.

In some embodiments, the formation testing operation is a simulated formation testing operation and/or wherein the temperature data and pressure data are simulated data for predicting the one or more internal forces for the simulated formation testing operation.

In some embodiments, the method further includes determining an axial pull on the packer based on the one or more internal forces.

In some embodiments, determining the axial pull includes determining that the axial pull will exceed an operational threshold of the packer.

In some embodiments, the method further comprises performing one or more remedial actions based on predicting the one or more internal forces.

In some embodiments, the remedial actions include causing the tool string to thermally contract before fixing the packer to the wellbore.

In some embodiments, causing the tool string to thermally contract includes circulating the fluid through the tool string to cool the tool string.

In some embodiments, the remedial actions include fixing the packer such that a slip joint of the tool string is not positioned in the middle of a stroke of the slip joint.

In some embodiments, the stroke of the slip joint is positioned to allow for more thermal contraction than thermal expansion.

In some embodiments, the remedial actions include causing a change in the thermal deformation based on adjusting a circulation rate of the fluid flowing through the tool string.

In some embodiments, the thermal deformation is determined based on the following formula:

$$\Delta L_1 = \int_0^L \alpha \Delta T dl$$

In some embodiments, estimating the deformation includes determining a ballooning deformation of the tool string.

In some embodiments, the ballooning deformation is determined based on the following formula:

$$\Delta L_2 = \frac{vL}{Et}\left(R_o \Delta P_o(z)_{average} - R_i \Delta P_i(z)_{average}\right)$$

In some embodiments, estimating the deformation includes determining a helical buckling deformation of the tool string.

In some embodiments, the helical buckling deformation is determined based on the following formula:

$$\Delta L_{helical} = \Delta L_1 + \Delta L_2 - C_{s2}$$

In some embodiments, the helical buckling is caused by thermal expansion of the tool string.

In some embodiments, predicting the one or more internal forces includes determining a friction force associated with a slip joint of the tool string.

In some embodiments, the friction force is associated with the slip joint sliding based on the deformation of the tool string.

In some embodiments, predicting the one or more internal forces are determined by accounting for the friction force based on the following formulas:

$$F_{deform} = \frac{\Delta L_{total}}{L} EA$$

$$\text{if } F_{deform} \leq F_f, \text{ then } \Delta L^a_{total} = 0, F^a_{internal} = F_{deform}$$

$$\text{if } F_{deform} > F_f, \text{ then } \Delta L^a_{total} = \Delta L_{total} - L_{history}, F^a_{internal} = F_f$$

In some embodiments, the deformation of the drill pipe includes a contraction.

In some embodiments, an internal force of the tool string is determined based on the following formula:

$$F_{tensile} = \frac{\Delta L_1 + \Delta L_2 - C_{s1}}{L} EA$$

In some embodiments, the deformation of the drill pipe includes an expansion, and wherein an internal force of the tool string is determined based on the following formula:

$$F_{compression} = \sqrt{\frac{8EIw(\Delta L_1 + \Delta L_2 - C_{s2})}{r_w^2}}$$

In some embodiments, a method of predicting loading of a tool string implemented in a wellbore includes, for a simulated formation testing operation of the wellbore, receiving simulated temperature data for the wellbore, receiving simulated pressure data for a fluid flowing through the tool string, and estimating a deformation of the tool string based on the simulated temperature data and the simulated pressure data and based on physical properties of the tool string including determining thermal deformation of the tool string, and during a formation testing operation of the wellbore, receiving temperature data for the wellbore, receiving pressure data for the fluid flowing through the tool string, and validating the estimated deformation based on comparing the temperature data to the simulated temperature data and based on comparing the pressure data to the simulated pressure data.

In some embodiments, the method further comprising, for the simulated formation testing operation of the wellbore, predicting one or more internal forces of the tool string based on the deformation and, for the formation testing operation of the wellbore, validating the predicted internal forces based on validating the estimated deformation.

In some embodiments, the method further comprising updating the estimated deformation and the predicted one or more internal forces based on the validation.

In some embodiments, the method further comprising adjusting one or more drilling parameters based on the updated prediction of the one or more internal forces.

In some embodiments, adjusting the one or more drilling parameters includes adjusting a circulation rate of the fluid through the tool string to cause a change in the thermal deformation of the tool string.

In some embodiments, the method further comprising determining that an operational limit of one or more downhole components will be exceeded based on the updated prediction of the one or more internal forces.

In some embodiments, the method further comprising stopping the formation testing operation based on determining that the operational limit will be exceeded.

In some embodiments, a system for formation evaluation includes a tool string implemented in a wellbore, a formation evaluation tool positioned in the wellbore and connected to the tool string with a slip joint, the slip joint having a set point relative to a stroke of the slip joint, a cable connected from the surface to the formation evaluation tool and passing through the tool string and the slip joint, wherein the set point of the slip joint is set based on a tensioning of the cable and wherein the set point of the slip joint is not set at a midpoint of the stroke.

In some embodiments, the set point is set to allow for more thermal contraction than thermal expansion.

In some embodiments, the cable is a connected to the formation evaluation tool for data communication with the formation evaluation tool.

In some embodiments, the slip joint has a total stroke length of less than 10 feet.

In some embodiments, the set point of the slip joint is set based on a predicted deformation of the tool string during a formation evaluation operation.

In some embodiments, a kit for formation evaluation includes a formation evaluation tool for positioning in the wellbore and connecting to a tool string, a slip joint for connecting the formation evaluation tool to the tool string, the slip joint having a set point relative to a stroke of the slip joint, a cable for connecting from the surface to the formation evaluation tool and passing through the tool string and the slip joint, wherein the set point of the slip joint is set based on a tensioning of the cable, and instructions for setting the set point of the slip joint not at a midpoint of the stroke.

In some embodiments, setting the set point is based on predicting a deformation of the tool string during a formation evaluation operation.

In some embodiments, a method for predicting loading of a tool string includes, for a formation testing operation, receiving temperature data for a wellbore, receiving pressure data for a fluid flowing through the tool string, applying a machine learning model to the temperature data and the pressure data, predicting one or more internal forces on the tool string based on the machine learning model.

The embodiments of the tool string deformation system have been primarily described with reference to wellbore drilling operations; the tool string deformation system described herein may be used in applications other than the drilling of a wellbore. In other embodiments, the tool string deformation system according to the present disclosure may be used outside a wellbore or other downhole environment used for the exploration or production of natural resources. For instance, the tool string deformation system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of predicting loading of a tool string implemented in a wellbore during a formation testing operation, the method comprising:

receiving temperature data for the wellbore;

receiving pressure data for a drilling fluid flowing through the tool string;

estimating a thermal deformation of the tool string based on the temperature data, the pressure data, and physical properties of the tool string; and predicting one or more internal forces on the tool string based on the estimating the thermal deformation, the one or more internal forces being indicative of the loading of the tool string.

2. The method of claim 1, wherein a packer is fixed to an open wellbore wall of the wellbore and wherein the tool string includes a downhole tool connected to the packer such that the tool string and the downhole tool are constrained to a limited axial movement.

3. The method of claim 2, wherein the downhole tool is configured such that a formation fluid flows into the downhole tool.

4. The method of claim 2, wherein the downhole tool is positioned at least 5000 meters below a surface of the wellbore.

5. The method of claim 2, wherein the tool string is closed to a downhole portion of the wellbore below the packer.

6. The method of claim 2, wherein the downhole tool is connected to the tool string with a slip joint.

7. The method of claim 6, wherein the slip joint has a stroke length of less than 10 feet.

8. The method of claim 6, wherein estimating the thermal deformation includes determining a stroke position of the slip joint.

9. The method of claim 1, wherein during the formation testing operation, the tool string is fixed to a surface of the wellbore.

10. The method of claim 1, further comprising determining a temperature profile of the wellbore based on a temperature simulation of the wellbore with the temperature data, wherein determining the thermal deformation is based on the temperature profile.

11. The method of claim 1, further comprising determining a pressure profile of the wellbore based on a pressure simulation of the wellbore with the pressure data, wherein determining the thermal deformation is based on the pressure profile.

12. The method of claim 1, wherein the thermal deformation includes one or more of thermal contraction of the tool string, thermal expansion of the tool string, ballooning of the tool string, or helical buckling of the tool string.

13. The method of claim 1, wherein:

the tool string comprises a packer fixed to an open wellbore wall of the wellbore; and predicting the one or more internal forces on the tool string comprises predicting a load on the packer based on the pressure data for the drilling fluid.

14. The method of claim 13, further comprising performing one or more remedial actions based on the predicting the one or more internal forces.

15. The method of claim 14, wherein the one or more remedial actions include causing the tool string to thermally contract before fixing an axial position of a formation evaluation tool of the tool string with the packer.

16. The method of claim 15 wherein the one or more remedial actions include fixing the packer such that a slip joint connecting the formation evaluation tool to the tool string is not positioned in a middle of a stroke of the slip joint.

17. The method of claim 14, wherein the one or more remedial actions include causing a change in the thermal deformation based on adjusting a circulation rate of the drilling fluid flowing through the tool string.

18. The method of claim 1, wherein predicting the one or more internal forces includes determining that a stroke of a slip joint is at a maximum extent.

19. A system, comprising:

at least one processor;

memory in electronic communication with the at least one processor; and instructions stored in the memory, the instructions being executable by the at least one processor to cause the at least one processor to:

for a formation testing operation of a wellbore:

receive temperature data for the wellbore;

receive pressure data for a drilling fluid flowing through a tool string;

estimating a thermal deformation of the tool string based on the temperature data, the pressure data, and physical properties of the tool string, and predicting one or more internal forces on the tool string based on the estimating the thermal deformation, the one or more internal forces being indicative of a loading of the tool string.

20. A computer-readable storage medium including instructions that, when executed by at least one processor, cause the at least one processor to:

for a formation testing operation of a wellbore:

receive temperature data for the wellbore;

receive pressure data for a drilling fluid flowing through a tool string;

estimating a thermal deformation of the tool string based on the temperature data, the pressure data, and physical properties of the tool string, and predicting one or more internal forces on the tool string based on the estimating the thermal deformation, the one or more internal forces being indicative of a loading of the tool string.

* * * * *